US006133895A

United States Patent [19]

Huang

[11] Patent Number: 6,133,895

[45] **Date of Patent: *Oct. 17, 2000**

[54] CUMULATIVE DRIVE SCHEME AND METHOD FOR A LIQUID CRYSTAL DISPLAY

[75] Inventor: Xiao-Yang Huang, Stow, Ohio

[73] Assignee: Kent Displays Incorporated, Kent, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,709

[22] Filed: Jun. 4, 1997

[51] Int. Cl.[7] ..... G09G 3/36

[52] U.S. Cl. ..... 345/94; 345/95

[58] Field of Search ..... 345/94, 95, 96, 345/97, 90, 87

[56] References Cited

U.S. PATENT DOCUMENTS

| | | |
|---|---|---|
| 4,317,115 | 2/1982 | Kawakami et al. . |
| 4,419,664 | 12/1983 | Crossland et al. . |
| 4,514,045 | 4/1985 | Huffman et al. . |
| 4,626,074 | 12/1986 | Crossland et al. . |
| 4,636,788 | 1/1987 | Hilbrink . |
| 4,641,135 | 2/1987 | Hilbrink . |
| 4,668,049 | 5/1987 | Canter et al. . |
| 4,705,345 | 11/1987 | Ayliffe et al. . |
| 4,728,175 | 3/1988 | Baron . |
| 4,761,058 | 8/1988 | Okubo et al. . |
| 4,769,639 | 9/1988 | Kawamura et al. . |
| 4,864,538 | 9/1989 | Buzak . |
| 4,909,607 | 3/1990 | Ross . |
| 4,958,915 | 9/1990 | Okada et al. . |
| 5,036,317 | 7/1991 | Buzak . |
| 5,132,823 | 7/1992 | Kamath et al. . |
| 5,168,378 | 12/1992 | Black et al. . |
| 5,168,380 | 12/1992 | Fergason . |
| 5,189,535 | 2/1993 | Mochizuki et al. . |

(List continued on next page.)

OTHER PUBLICATIONS

PCT International Search Report, Mailing Date Feb. 2, 1999, 4 pages.

Article entitled *Cholesteric Liquid Crystal Texture Change Displays*, by J.J. Wysock, Gary A. Dir, J.H. Becker, J.E. Adams, W.E. Haas, L.B. Leader, B. Mechlowitz and E.D. Saeva, published in the Proceeding of the S.I.D. vol. 13/2 Second Quarter, pp. 105–113 (1972).

Article entitled *Front–Lit Flat Panel Display Polymer Stabilized Cholesteric Textures*, J.W. Doane, D.K. Yang and Z. Yaniv, published in Japan Display, pp. 73–76 (1992).

(List continued on next page.)

*Primary Examiner*—Steven J. Saras
*Assistant Examiner*—Alecia D. Nelson
*Attorney, Agent, or Firm*—Watts, Hoffmann, Fisher & Heinke, Co., L.P.A.

[57] ABSTRACT

A liquid crystal display including driver circuitry which applies a series of voltage pulses at a frequency of approximately 60 Hz. to cumulatively change a reflectance state of a pixel in an array of pixels at a near video updating rate. The display includes a near video rate updating portion, while the remainder of the display has a slower updating frequency or rate. The display is comprised of a bistable cholesteric liquid crystal material sandwiched between an electrode array having a plurality of row and column electrodes. In one operating embodiment, the driver circuitry generates a unipolar row and column waveforms, the row waveforms being applied to the row electrodes and the column waveforms being applied to the column electrodes of the near video rate updating portion. Approximately every 16 milliseconds, a pixel in the near video rate updating portion receives a control voltage pulse corresponding to the difference between the row and column waveforms. Application of six to seven control voltage pulses is sufficient to change the reflectance state of the pixel. In a second operating embodiment, the driver circuitry generates bipolar row and column waveforms. In alternate embodiments, dual column driver circuitry is provided and interlacing schemes are used to increase the number of rows in the near video rate updating portion of the display.

42 Claims, 20 Drawing Sheets

U.S. PATENT DOCUMENTS

| | | | |
|---|---|---|---|
| 5,251,048 | 10/1993 | Doane et al. . | |
| 5,252,954 | 10/1993 | Nagata et al. . | |
| 5,260,699 | 11/1993 | Lister et al. . | |
| 5,280,280 | 1/1994 | Hotto . | |
| 5,285,214 | 2/1994 | Bowry . | |
| 5,289,175 | 2/1994 | Kawagishi . | |
| 5,289,300 | 2/1994 | Yamazaki et al. . | |
| 5,293,261 | 3/1994 | Shashidhar et al. . | |
| 5,315,101 | 5/1994 | Hughes et al. . | |
| 5,384,067 | 1/1995 | Doane et al. . | |
| 5,437,811 | 8/1995 | Doane et al. . | |
| 5,453,863 | 9/1995 | West et al. . | |
| 5,488,499 | 1/1996 | Tanaka et al. . | |
| 5,625,477 | 4/1997 | Wu et al. . | |
| 5,644,330 | 7/1997 | Catchpole et al. . | |
| 5,717,418 | 2/1998 | Shapiro et al. | 345/89 |
| 5,724,060 | 3/1998 | Graham et al. | 345/97 |
| 5,748,277 | 5/1998 | Huang et al. | 345/95 |
| 5,933,203 | 8/1999 | Wu et al. | 349/35 |

OTHER PUBLICATIONS

Article entitled *Cholesteric Liquid Crystal/Polymer Gel Dispersion*: Reflective Display Application, by D.K. Yang and J.W. Doane, published in the SID Technical Paper Digest vol. XXIII May, p. 759 (1992).

Article entitled *Zero Field, Multistable Cholesteric Liquid Crystal Displays*, authors, presented at IDRC Proceedings, Oct. 10–15, 1994, pp. 476–479 (1994).

210
212
+60
V COL (VOLTS)
0
−60
1msec
170
(SWITCH TO PLANAR CONFIGURATION)
(SWITCH TO FOCAL CONICAL CONFIGURATION)
SELECTED ROW
V ROW (VOLTS)
V PIXEL (VOLTS)
290
292
172
(REMAIN IN PRESENT CONFIGURATION)
NONSELECTED ROW
294
296

154
158
+60
V ROW (VOLTS)
156
164
168
160
166
169
+5
TIME
1.3μsec
498.7μsec
16μsec
484μsec

CUMULATIVE DRIVE SCHEME AND METHOD FOR A LIQUID CRYSTAL DISPLAY

This application in part with Government support under cooperative agreement number N61331-94C-0041 awarded by the Defense Advanced Research Projects Agency (DARPA). The Government has certain rights in this invention.

FIELD OF THE INVENTION

This invention relates to drive circuitry and method for a liquid crystal display and, more particularly, to drive circuitry and method for a bistable cholesteric liquid crystal display which provides video rate compatible updating of display screen images.

BACKGROUND OF THE INVENTION

Liquid crystal displays have been widely adapted for use in a number of products such as digital watches and clocks, laptop computers, and information and advertising display signs. Generally, the display includes a thin layer of liquid crystal material sandwiched between two transparent panels. An electrode array comprising a first set or plurality of parallel oriented electrode segments (row electrode segments) disposed on an inwardly facing side of one panel and a second set or plurality of parallel oriented electrode segments (column electrode segments) which are perpendicular to the row electrode segments disposed on an inwardly facing side of the other panel is provided. The row and column electrode segments are spaced apart by spacer material and the liquid crystal material is filled in the spaced apart region between the panels.

Display picture elements or pixels are defined by regions of liquid crystal material adjacent the intersections of aligned electrodes of the horizontal and vertical electrode segments of the electrode array. Upon application of a suitable electric field, a pixel will assume either a reflective or a non-reflective state. A pixel, pi,j, formed at the overlapping or intersection of the ith row electrode and the jth column electrode is subject to an electric field resulting from the potential difference between a voltage applied to the ith row electrode segment and a voltage applied to the jth column electrode segment.

Recent advances in liquid crystal material research has resulted in the discovery of bistable chiral nematic (also called cholesteric) liquid crystal materials. Cholesteric liquid crystal materials are able to maintain a given state (reflective or nonreflective) without the need for the constant application of an electric field. When data or an image displayed on a display is to be changed, some pixels will require a change in their state of reflectance while others will not. The display driver circuitry appropriately changes the electric field applied to those pixels whose reflectance states need to be changed in order to effect the desired change.

If the panel furthest from the viewer is painted with a black substrate, a pixel with a low reflectance will appear as a black area to the viewer. If the liquid crystal material has a light color appearance (such as yellow) in its highly reflective state, a pixel in a high reflectance state will appear to the viewer as a lighter colored area on the display.

Display driver circuitry is coupled to the vertical and horizontal electrodes of the electrode array. Operating under the control of a logic and control unit, the display driver circuitry energizes the row and column electrodes with appropriate voltage waveforms such that an appropriate voltage across each pixel is generated. The voltage across a pixel will either cause it to remain in its present state of reflectance or change its state of reflectance. The image generated by the display pixels may be modified by changing the state of selected pixels. In this way, text or image data can be presented for viewing.

In the invention disclosed in U.S. application Ser. No. 08/390,068, filed Feb. 17, 1995 and entitled "Dynamic Drive Method and Apparatus For a Bistable Liquid Crystal Display," a method and display driver circuitry for speeding the rate of updating a 1,000 row cholesteric liquid crystal display was disclosed. Application Ser. No. 08/390,068 is incorporated herein in its entirety by reference. An updating time of approximately one second for a 1000 row display was achieved. By simultaneously addressing multiple rows of the display with a pipelining scheme, the overall updating time for the display was kept at one second.

The dynamic drive disclosed in application Ser. No. 08/390,068 represents a significant reduction in update time for a 1,000 row liquid crystal display. However, while a one second updating time is suitable for display of static images, e.g., a map image, text material, etc., such an update time does not correspond to video display rate and is too slow to provide the appearance of continuous movement of moving images to the human eye in certain applications.

SUMMARY OF THE INVENTION

A liquid crystal display utilizing a bistable cholesteric liquid crystal material and display driver circuitry capable of generating video rate updating of slow moving images displayed on the display is disclosed. The display driver circuitry and method is denoted as a cumulative display driver and method because it generates short duration row and column voltage waveforms that are applied to selected row and column electrode segments defining a pixel. The row and column waveforms result in a voltage pulse of a desired magnitude across the pixel. As a plurality of such pulses are applied to the pixel it gradually changes from one reflectance state to a desired new reflectance state.

The display is defined by two panels which sandwich a thin layer of cholesteric liquid crystal material. The display includes an array of electrodes comprising a first set of parallel electrode segments (row electrode segments) affixed to an inner surface of one panel and a second set of parallel electrode segments (column electrode segments), substantially orthogonal to the first set of parallel electrode segments, affixed to an inner surface of the other panel.

The row and column electrode segments are spaced apart by the liquid crystal material. Pixels of the display are defined by regions of liquid crystal material between and adjacent to spaced apart, aligned electrodes of the row and column electrode segments. The display includes a portion that is updated or refreshed at a video or near video rate. A video or near video updating rate means that a displayed image that is constantly changing, i.e., to shown movement such as an image of a person walking or a moving vehicle, would be perceived by a human eye looking at the video rate display portion as a continuously moving image so long as the image movement is not extremely fast. The display electronics are compatible with video rate or near video rate updating, that is, the display driver circuitry and associated electronics of the display are capable of receiving, displaying and updating image data at a rate that would provide the appearance of continuously moving images on the video rate display portion. In a first embodiment, the video rate updating portion of the display includes sixteen row electrode segments corresponding to sixteen lines of pixels that are updated at a video or near video rate.

With regard to the video rate portion of the display, the driver circuitry includes row driver circuitry electrically coupled to the row electrode segments and column driver circuitry electrically coupled to column electrode segments and control circuitry for synchronizing and controlling the application of waveforms generated by the row and column driver circuitry to individual pixels. The rows of pixels (that is, the row electrode segments corresponding to the pixel rows) are addressed sequentially in approximately 1 millisecond (ms.) intervals. Thus, the sixteen pixel rows of the video updating portion of the display are addressed in a total of approximately 16 ms. to achieve a flicker free image. Stated another way, each pixel row is addressed approximately every 16 ms. All the pixel columns (that is, the column electrode segments corresponding to the pixel columns) are addressed continuously.

In a first operating embodiment of the video rate display portion of the display, row and column driver circuitry are provided that generate unipolar waveforms. The control circuitry synchronizes the application of the row and column driver circuitry unipolar waveforms to pixels in the addressed pixel row. A pixel in the addressed row whose reflectance is either to remain in a high reflectance state or is to be changed to a high reflectance state will receive a substantially square wave voltage pulse having a peak magnitude of 60 volts (120 volts peak-to-peak, centered about zero volts). The pulse width or duration of the voltage pulse will be approximately 1 ms.

On the other hand, a pixel in the addressed row whose reflectance is either to remain in a low reflectance state or is to be changed to a low reflectance state will receive a substantially square wave voltage pulse having a peak magnitude of 50 volts (100 volts peak-to-peak, centered about zero volts) and a pulse width of 1 ms.

In a second operating embodiment of the video rate display portion, row and column driver circuitry are provided that generate bipolar waveforms. The control circuitry synchronizes the application of the row and column driver circuitry bipolar waveforms to pixels in the addressed pixel row. As in the first embodiment, a pixel in the addressed row whose reflectance is either to remain in a high reflectance state or is to be changed to a high reflectance state will receive a substantially square wave voltage pulse having a peak magnitude of 60 volts (120 volts peak-to-peak, centered about zero volts) and a pulse width of 1 ms. while a pixel in the addressed row whose reflectance is either to remain in a low reflectance state or is to be changed to a low reflectance state will receive a substantially square wave voltage pulse having a peak magnitude of 50 volts (100 volts peak-to-peak, centered about zero volts) and a pulse width of 1 ms.

In both the unipolar and bipolar operating embodiments, the voltage pulses have a time between successive pulses or a period, T, of approximately 16 ms. which corresponds to an updating frequency, f, of approximately 60 Hz.

In a second embodiment of the present invention, the video rate display portion comprises two sets of electrode segments each comprising sixteen row electrode segments by 320 column electrode segments. Each set of electrodes is driven or updated by independent column driver circuitry. This embodiment provides for a doubling of the number of pixel rows in the video rate updating portion from 16 to 32. A first set of column driver circuitry is coupled to the first set of column electrodes and a second set of column driver circuitry is coupled to the second set of column electrodes.

In a third embodiment of the present invention, the video rate display portion comprises two sets of electrode segments each comprising 32 row electrode segments by 320 column electrode segments. Each set of electrodes is driven or updated by independent column driver circuitry. A first set of column driver circuitry is coupled to the first set of column electrode segments and a second set of column driver circuitry is coupled to the second set of column electrode segments. This embodiment increases the number of pixel rows in the display from 32 to 64. An interleaving or interlacing scheme is used to update or address alternate rows at the 60 Hz. frequency. Thus, an individual pixel in the display is updated at a frequency of 30 Hz. or approximately every 32 ms.

In a fourth embodiment of the present invention, the video rate display portion comprises two sets of electrode segments each comprising 48 row electrode segments by 320 column electrode segments. Each set of electrodes is driven or updated by independent column driver circuitry. A first set of column driver circuitry is coupled to the first set of column electrode segments and a second set of column driver circuitry is coupled to the second set of column electrode segments. This embodiment increases the number of pixel rows in the display from 32 to 96. An interleaving or interlacing scheme is used to update or address alternate every third row at the 60 Hz. frequency. Thus, an individual pixel in the display is updated at a frequency of 20 Hz. or approximately every 48 ms.

DETAILED DESCRIPTION

Figure 1:
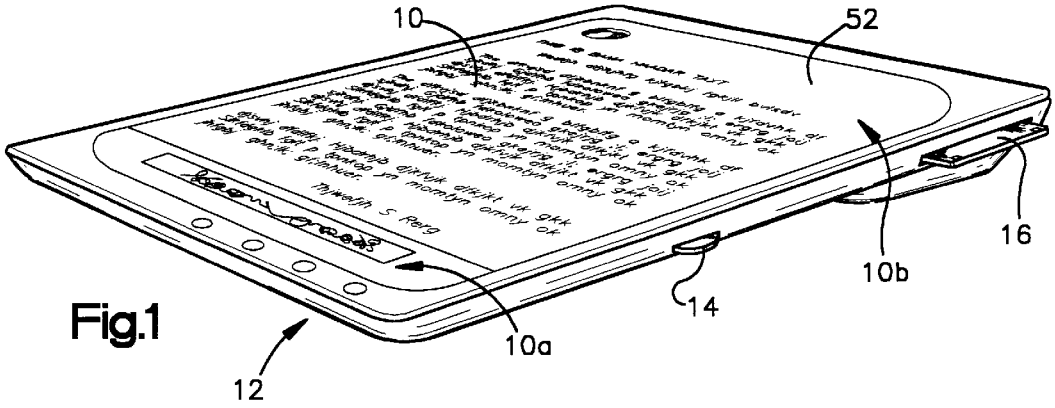
FIG. 1 is a perspective view showing a flat-panel liquid crystal display used for displaying images on a portable document viewer, the display includes a portion wherein the image is updated at a video or near video rate.

Turning to the drawings, FIG. 1 shows a flat-panel a passive matrix cholesteric liquid crystal display (Ch-LCD) 10 for use with a document viewer 12. The particular viewer 12 shown in FIG. 1 is a portable electronic viewer for viewing text and images. The display includes a video rate updating portion 10*a* and a slower or static rate updating portion 10*b*. The video rate updating portion 10*a* is adapted to display an image or images which are constantly changing or are moving at a relatively slow rate. Such displayed images are updated fast enough by the video rate updating portion 10*a* such that a user of the viewer 12 would perceive a smooth continuous motion of, for example, objects moving in the displayed image (an image of a person walking or a car being driven) instead of perceiving movement of the objects as a series of abrupt, discontinuous movements. For example, a motion picture film is shown at a rate or frequency of 24 frames per second which corresponds to an "updating" of the image every 0.0467 seconds (46.7 milliseconds (ms.)). A human eye perceives the image of the projected film as a continuous motion image.

However, even slower updating rates may still be viewed by the human eye as a continuous motion image where the image change is relatively slow, for example, in applications such as image interchange, text typing, computer mouse movement and window scrolling. In the video rate updating portion 10*a* of the display 10, a given image pixel pi,j will completely change state (reflectance to non-reflectance or vice versa) after the application of six or seven one millisecond (1 ms.) duration voltage pulses. As will be explained below, for a given pixel pi,j, the application of a voltage pulse occurs approximately every 16 ms. Thus, the total updating time, that is, the time necessary to completely change the reflectance state of the pixel pi,j in the video rate updating portion 10*a* of the display 10 will take approximately 96 ms. to 112 ms. (6 pulses×16 ms. between successive pulses or 7 pulses×16 ms. between successive pulses). While this updating rate of the video rate updating portion 10*a* is slower than conventional film projecting which provides a new frame every 46.7 ms., it is still a fast enough such that slower moving images displayed on the video rate updating portion 10*a* are perceived as continuously moving to a viewer of the display 10.

The video rate updating portion 10*a* is driven by display driver circuitry 13 (discussed below in connection with FIGS. 9–14) capable of receiving, displaying and updating image data at a rate that is compatible with video rate or near video rate updating.

The static portion 10*b* of the display 10 does not have the same frequency of updating the displayed image as the video rate updating portion 10*a*. The static portion 10*b* of the display 10 is appropriate for displaying images which are relatively static, that is, do not include moving objects, e.g., a page of text from a book or magazine. For example, the text of successive pages of a magazine article could be displayed in the display portion 10*b* while a video presentation accompanying the article could be displayed in the display portion 1*a*.

The static portion 10*b* of the display 10 may advantageously be driven by the dynamic driver circuitry configuration disclosed in U.S. application Ser. No. 08/390,068, filed Feb. 17, 1995 and entitled "Dynamic Drive Method and Apparatus For A Bistable Liquid Crystal Display" and incorporated herein by reference. This dynamic driver circuitry when properly reconfigured can be used for driving the video rate updating portion 10*a*.

Figure 1A:
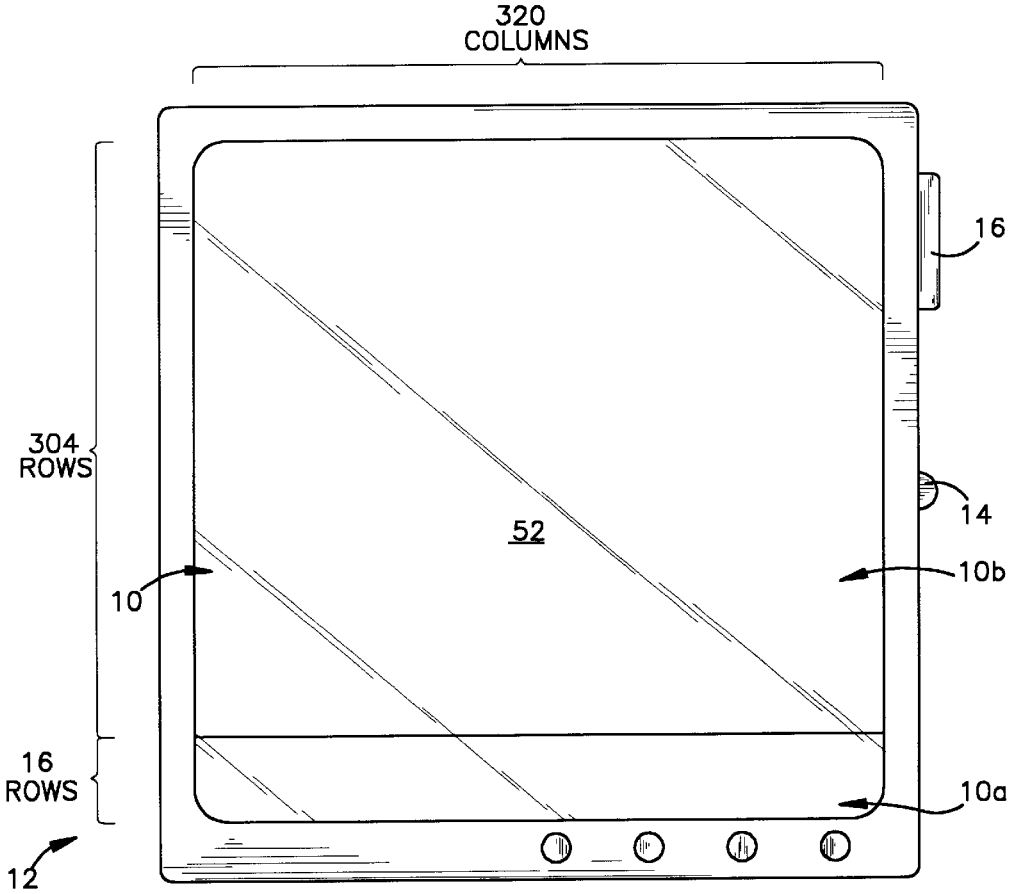
FIG. 1A is a top plan view of the flat panel liquid crystal display of FIG. 1.

As can be seen in FIG. 1A, the video rate updating portion 10*a* of the display 10 comprises 16 rows by 320 columns of pixels, while the static portion 10*b* comprises 304 rows by 320 columns of pixels. It should be appreciated that since the number of rows in the static portion 10*b* is nine times as great as the number of rows in the video rate updating portion 10*a*, the total updating time for a given pixel in the static portion 10*a* will be nine time as large as the total updating time in the video rate updating portion 10*b*.

The viewer 12 supports the display driver circuitry 13 (shown schematically in FIGS. 9 and 12–14) coupled to the display 10 to energize the display such that a desired image is displayed. The display driver circuitry 13 is adapted to update images on the video rate updating portion 10*a* of the display 10 at a video rate and to update images on the static portion 10*b* at a non-video rate.

The viewer 12 includes an integral selection switch 14 and a memory card or floppy disk 16 which can carry the information to be viewed on the display 10. Such a viewer 12 may advantageously include a hard disk drive, a floppy disk drive, a radio frequency (rf) transceiver and/or various other input/output devices.

The display 10 is constructed using a reflective bistable chiral nematic liquid crystal material 18 (also referred to as a bistable cholesteric liquid crystal material) whose reflectance state (reflective or non-reflective) can be controlled by application of a control voltage across the liquid crystal material. Suitable cholesteric liquid crystal materials and cells, as well as their manner of preparation would be known to those of ordinary skill in the art. Preferred cholesteric liquid crystal materials and cells are disclosed in, for example, co-pending application Ser. Nos. 08/057,662, filed May 4, 1993, and 07/969,093, filed Oct. 30, 1992, the disclosures of which are incorporated herein by reference.

Figure 2A:
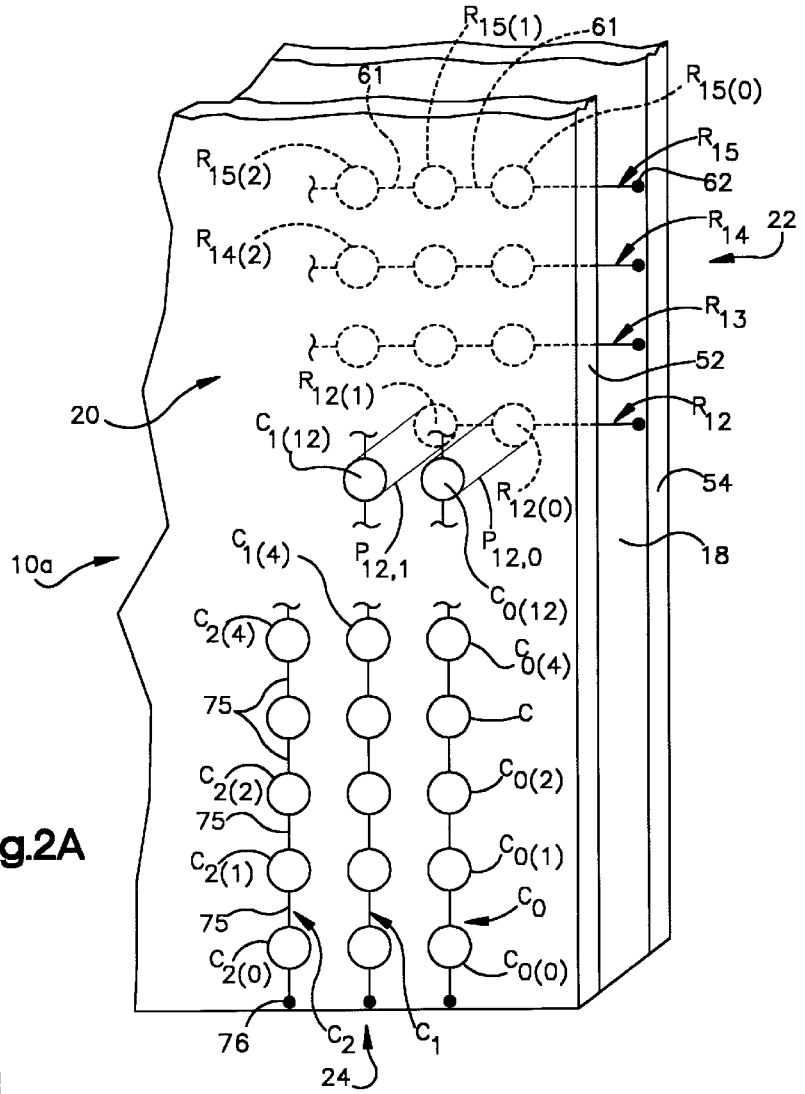
FIG. 2A is a perspective view of a schematic representation of row and column electrode segments of the video rate display portion of the flat-panel display.
Figure 2B:
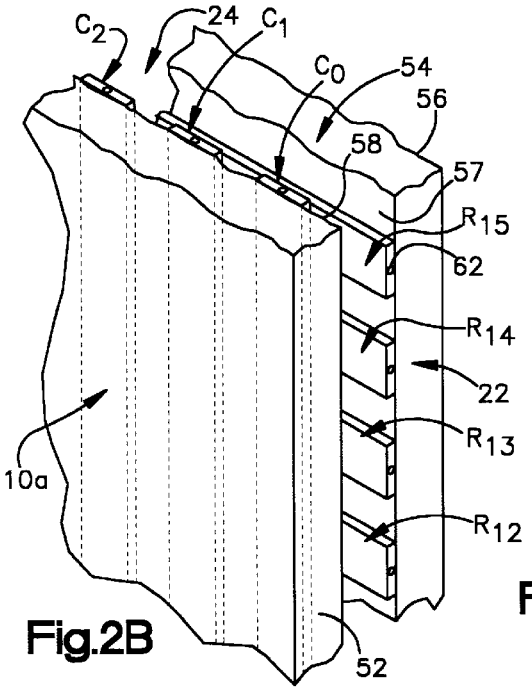
FIG. 2B is a perspective view of a schematic representation an electrode array of the video rate display portion of the flat-panel display.

FIGS. 2A and 2B illustrate a portion the display 10 including part of the video rate portion 10*a* of the display 10. The display 10 includes a 320 row by 320 column array of conductive electrodes (row electrode segments 20 and column electrode segments 22). Of the total conductive electrode array, the video rate portion 10*a* of the display 10 includes sixteen of the 320 row electrode segments 20 and all 320 column electrode segments 22. The static display portion 10*b* of the display 10 includes 304 of the 320 row electrode segments 20 and all 320 column electrode segments 22. The electrode array 20 includes a plurality of segments of horizontally connected electrodes (row electrode segments) 22 and a plurality of segments of vertically connected electrodes (column electrode segments) 24. In the portion of the video rate portion 10*a* of the display 10 seen in FIGS. 2A and 2B, the row electrode segments 22 are labeled R0, R1, . . . , R14, R15, while the column electrode segments 24 are labeled C0, C1, . . . , C319. The row and column electrodes segments 22, 24 are substantially orthogonal and are separated by the thin layer of cholesteric liquid crystal material 18. Picture elements or pixels of the display 10 are defined by portions of the cholesteric liquid crystal material 18 adjacent an overlapping or intersection of aligned electrodes of the row and column electrode segments 22, 24. The pixels comprise an array of pixels 25, best shown in FIG. 2D. At any given time, each pixel of the pixel array 25 is either in a reflective display state or a non-reflective display state. The pixel array 25 thereby forms an image which is viewed on the display 10. As will be discussed below, the row and column electrodes segments 22, 24 are energized by display driver circuitry 13 (FIG. 9) to apply a control voltage across each pixel. The control voltage across a pixel pi,j subjects the pixel to an applied electric field and determines a display state of the pixel.

The perspective schematic view of FIG. 2A shows a portion of the the video rate portion 10*a* of the display 10. A layer (thickness of 5 microns) of bistable cholesteric liquid crystal material 50 is sandwiched between two clear containment plates 52, 54. The containment plates 52, 54 are spaced apart by uniformly applied spacer material. The plates and the spacer material do not interfere with the light reflecting or transmissive characteristics of the liquid crystal display material. An outer surface 56 (FIG. 2B) of the rearward containment plate 54 is coated with a dark color such as the color black such that when a pixel is in reflective state it appears at a light color (e.g., yellow color if the cholesteric material has a specific reflection peak corresponding to the color yellow).

Attached to an inner surface 57 of the rearward containment plate 54 are the parallel row electrode segments 22. Portions of four parallel row electrode segments R12, R13, R14, R15 are shown schematically in an upper portion of FIG. 2A. Looking at the row electrode segment R15 as an example, the segment R15 is comprised of a plurality of electrodes R15(0), R15(1), R15(2), . . . , R15(319) (only R15(0), R15(1), R15(2) are shown) extending substantially across a width of the display 10. The electrodes R15(0), R15(1), R15(2), . . . are interconnected by conductive leads 61 which terminates in a conductive connector 62 at an edge of the containment plate 54. Thus, if a voltage is applied to the conductive connector 62, all the electrodes R15(0), R15(1), R15(2), . . . in the segment R15 have the same voltage or electrical potential. The other row electrode segments R0, . . . R15 are similarly configured. In a first embodiment of the display 10, there are 16 row electrode segments in the video rate updating portion 10*a*.

Attached to an inner surface 58 (FIG. 2B) of the front containment plate 52 are the parallel column electrode segments 24. Portions of three parallel column electrode segments C0, C1, C2 are shown schematically in a lower portion of FIG. 2A. Looking at the column electrode segment C2 as an example, the segment C2 is comprised of a plurality of electrodes C2(0), C2(1), C2(2), . . . , C2(15) (only C2(0), C2(1), C2(2), C2(4) are labeled and shown) extending substantially across a height of the display 10. The electrodes C2(0), C2(1), C2(2), . . . , C2(15) are interconnected by conductive lead 75 which terminates in a conductive connector 76 at an edge of the containment plate 52. Thus, if a voltage is applied to the conductive connector 76, all the electrodes C2(0), C2(1), C2(2), . . . , C2(15) in the segment 74 have the same voltage or electrical potential. The other column electrode segments C0, C1, . . . , C319 are similarly configured. In a first embodiment of the display 10, there are 320 column electrode segments in both the video rate updating portion 10*a* and the static portion 10*b* of the display. The static portion 10*b* shares the same column driver circuitry (to be discussed below) and column electrode segments 22 with the video rate updating portion 10*a* but has its own row driver circuitry and row electrode segments for displaying images on the static portion 10*b*. As is typical practice, to achieve desired electrical and optical characteristics, one or more coating layers are applied to the in surfaces 57, 58 of the plates 52, 54 after the row and column electrode segments have been affixed to their respective plates. Suitable coatings include polyimide resin and silicon dioxide ($SiO_2$).

The row and column electrode segments 22, 24 are configured and spaced such that row and column electrodes of the segments 22, 24 are aligned forming an array of picture elements or pixels pi,j. For example, as can be seen in the middle portion of FIG. 2A, two pixels denoted p12,0 and p12,1 are schematically illustrated. The pixel p12,0 is formed at an intersection of row electrode segment R12 and column electrode segment C0 and, specifically, at an intersection of two aligned electrodes, namely, electrode R12(0) of the row electrode segment R12 and electrode C0(12) of the column electrode C0. The pixel p12,1 is formed at an intersection of row electrode segment R12 and column electrode segment C1 and, specifically, at an intersection of two aligned electrodes, namely, electrode R12(1) of the row electrode segment R12 and electrode C1(12) of the column electrode C1.

Figure 2C:
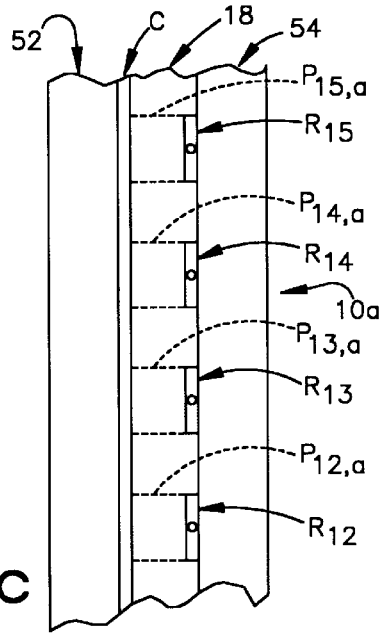
FIG. 2C is a side view of a schematic view of the flat-panel display of FIG. 2B.
Figure 2D:
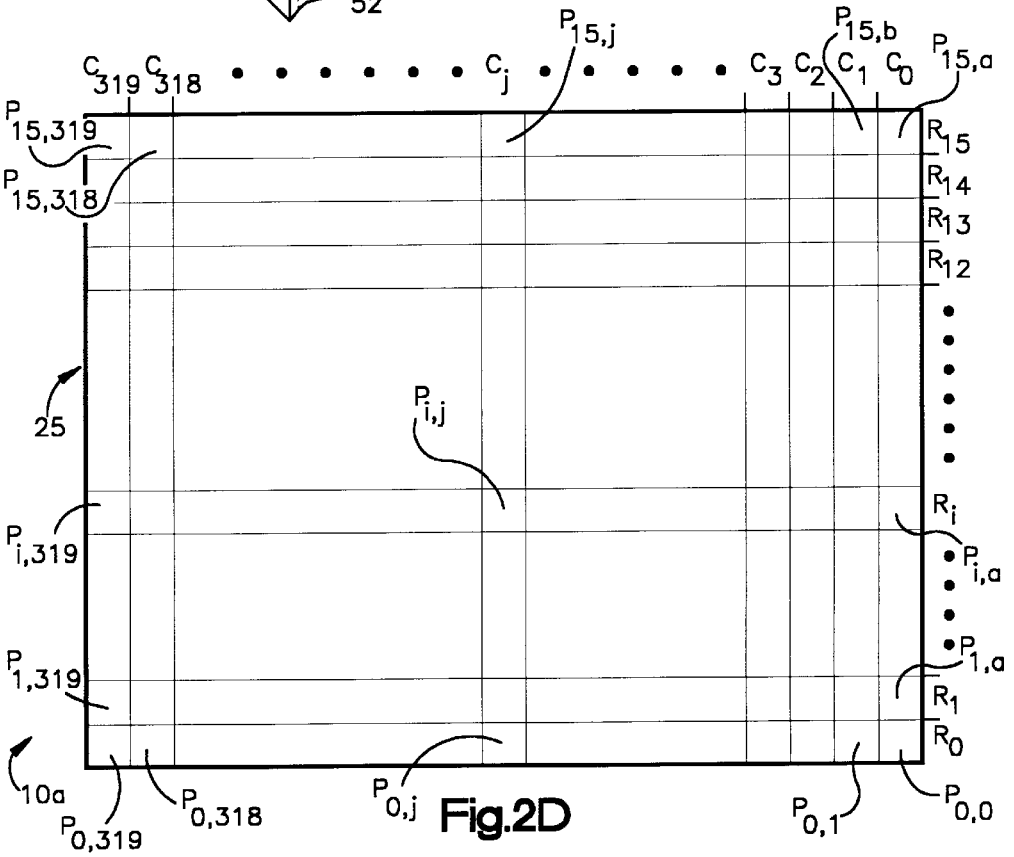
FIG. 2D is a schematic representation of picture elements or pixels of the video rate display portion of the flat-panel display.

FIGS. 2B and 2C depict a second representation of the row and column electrode segments 22, 24 more accurately reflecting the structure of the passive matrix type display 10. As can be seen in FIG. 2B, plates 52, 54 support transparent electrode segments 22, 24 which are coated as thin rectangles onto the substrate plates. The pixels occur at the intersection or overlapping of aligned row and column electrode segments 22, 24. FIG. 2D schematically represents the pixel array 25 resulting from the overlapping row and column electrode segments R0, R1, R2, . . . , R14, R15, C0, C1, . . . , C319 for the video rate updating portion 10*a* of the display 10. The pixel array 25 comprises 16 rows and 320 columns.

A display state (reflective or non-reflective) of a representative pixel pi,j (FIG. 2D) is controlled by a control voltage applied across pi,j. The control voltage applied to the pixel pi,j is a difference between the a voltage applied to the row electrode segment Ri and a voltage applied to the column electrode segment Cj. As noted above, all the electrodes in a given row electrode segment all have the same electric potential and all the electrodes in a given column electrode segment all have the same electric potential. Thus:

$$V(pi,j)=V(Ri)-V(Cj)$$

where:

V(pi,j)=the voltage across pixel defined by electrodes Ri(j) and Cj(i)

V(Ri)=the voltage applied to row electrode segment Ri

V(Cj)=the voltage applied to column electrode segment Cj

Depending on the control voltage applied, a pixel may exhibit one of three configurations or textures: planar, focal conical and homeotropic. In the planar texture, the pixel exhibits high reflectance of incident light (reflectance state), while in the focal conical texture, the pixel exhibits weak forward scattering of incident light and, thus, is non-reflective (non-reflectance state). Both of these configurations are stable at zero electric field. The planar configuration is typically referred to as the "on" state and the focal conical configuration is referred to as the "off" state. The homeotropic configuration is transparent (non-reflective) and is only achieved when the pixel is subjected to an appropriate electric field.

Figure 3A:
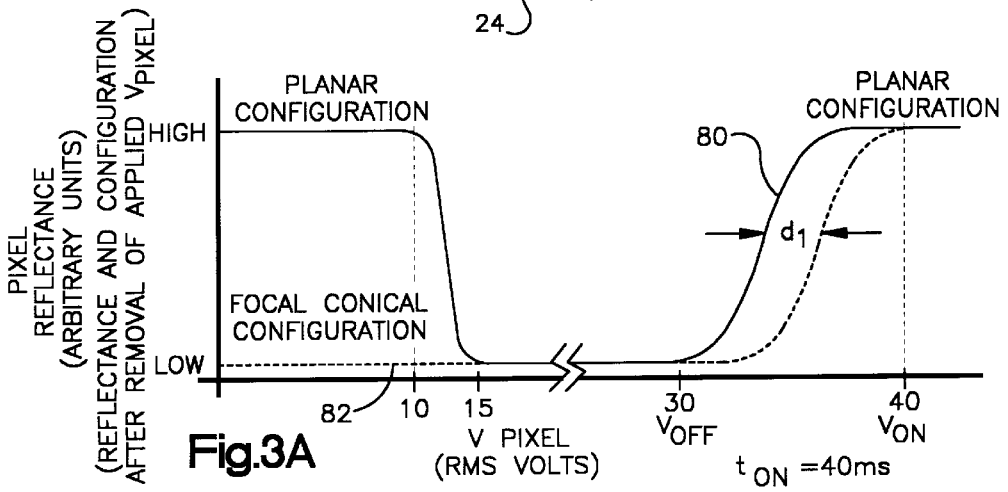
FIG. 3A is a graph illustrating a reflectance transition of a pixel of a liquid crystal display for a pixel initially in a planar configuration and a pixel in a focal conical configuration for application of an electric field having a duration of 40 milliseconds (ms.), the reflectance of the pixel being measured after the electric field applied to the pixel has ended.
Figure 3B:
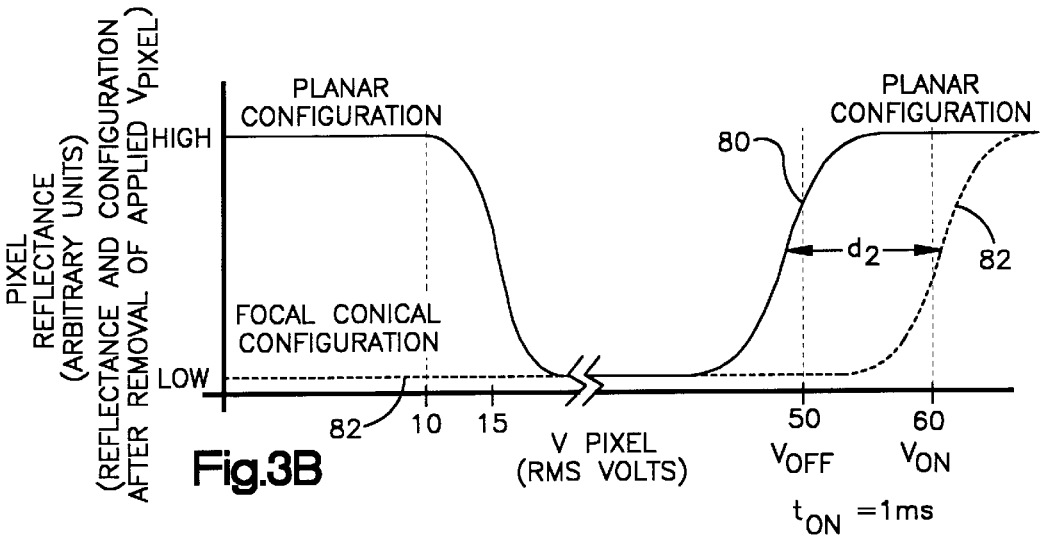
FIG. 3B is a graph illustrating a reflectance transition of a pixel of a liquid crystal display for a pixel initially in a planar configuration and a pixel in a focal conical configuration for application of an electric field having a duration of 1 ms., the reflectance of the pixel being measured after the electric field applied to the pixel has ended.

FIGS. 3A and 3B illustrate control voltages and transition paths for moving a pixel from a non-reflectance state to a reflectance state and vice versa under two different conditions. In the first condition, shown in FIG. 3A, the application of a control voltage to the pixel has a relatively long duration such as 40 ms. In the second condition, shown in FIG. 3B, the application of a control voltage to the pixel has a relatively short duration such as 1 ms. The difference between the shape of the transistion paths seen in FIGS. 3A and 3B combined with requirements related to obtaining sufficient reflectance of nonselected row pixels to be switched to the planar configuration necessitates the use of a cumululative drive scheme as presented herein to drive the display 10 at a video rate compatible updating rate.

The term "Von" will be used to refer to an application of a control voltage to a pixel with the purpose of changing the pixel to a high reflectance state (planar configuration). The term "Voff" will be used to refer to an application of a control voltage to a pixel with the purpose of changing the pixel to a low reflectance state (focal conical configuration). The term "Vnonselect" will be used to refer to an application of a control voltage to a pixel during times other than when either of the two control voltages Von or Voff are applied to the pixel. As will be discussed below, at any point in time, only those pixels corresponding to the currently selected row-electrode segment will be subjected to either the Von or Voff control voltage, the remainder of the pixels, that is, the pixels in the nonselected rows will be subjected to the Vnonselect control voltage across the pixel.

As can be seen from looking at right hand portions of the the transition curves presented in FIGS. 3A and 3B, the horizontal distance d1 between a curve 80 and a curve 82 at a given reflectance value in FIG. 3A is significantly less than the corresponding horizontal distance d2 between a curve 80 and a curve 82 for that some given reflectance value in FIG. 3B. The curves labeled 80 in FIGS. 3A and 3B represent the transition path for a pixel originally in the planar configuration, while the curves labeled 82 in FIGS. 3A and 3B represent the transition path for a pixel originally in the focal conical configuration. Thus, as can be seen in FIG. 3A, a difference between Von and Voff (AV) of 10 volts rms ($\Delta V$=Von−Voff=40−30=10 volts rms) is sufficient given the transition paths 80, 82 in FIG. 3A to drive a pixel as desired to either a sufficiently low reflectance state or a sufficiently high reflectance state when the Von or Voff voltage is applied to the pixel for a relatively long duration or period such as 40 ms. However, as can be seen in FIG. 3B, the same $\Delta V$ of 10 volts rms is not sufficient given the transition paths 80, 82 in FIG. 3B to drive a pixel to either a sufficiently low reflectance state or a sufficiently high reflectance state is for a relatively short period such as 1 ms.

A Von or Voff duration of 40 ms., while providing "better" transition paths, is too slow to be compatible with a video updating rate. A Von or Voff duration of 1 ms. provides rapid updating of the display 10 but results in "poorer" transition paths, that is the gap between the paths 80, 82 is greater. As will be discussed below, obtaining desired reflectance levels require $\Delta V$ to be limited to values such as 10 volts. Thus, a cumulative drive scheme is required to change pixel configurations and achieve video rate compatible updating.

Figure 4C:
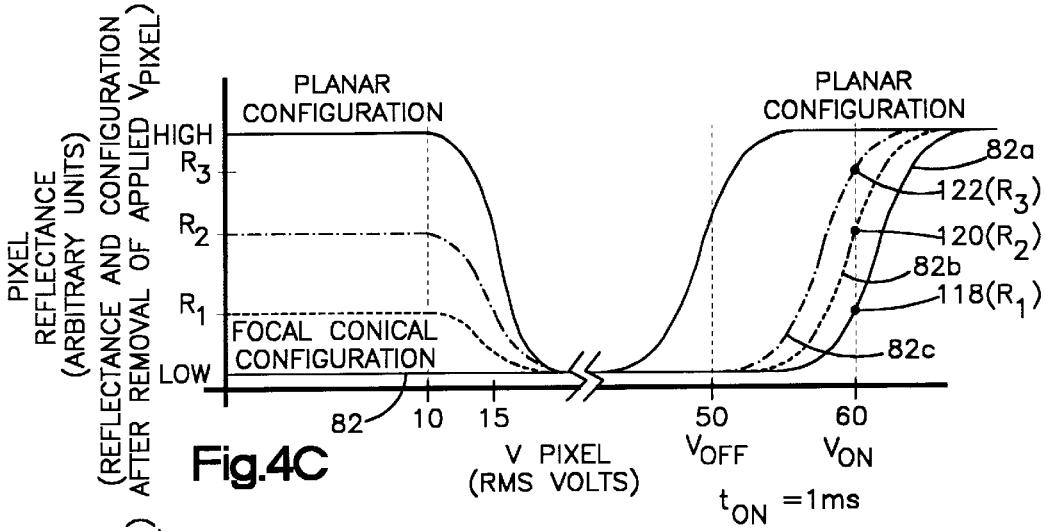
FIG. 4C is a schematic representation of the cumulative change in pixel reflectance from a low reflectance state to a high reflectance state resulting from short duration applications of a control voltage.
Figure 4A:
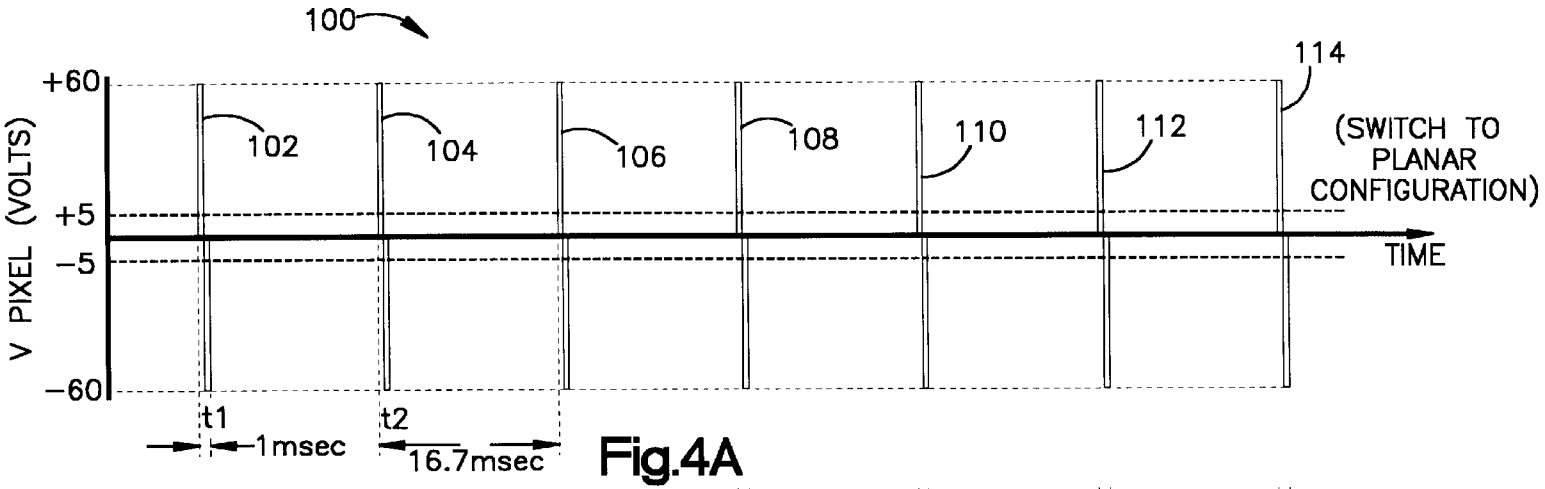
FIG. 4A is a schematic representation of a waveform as a function of time comprising a series of voltage pulses applied to a pixel to switch the pixel to a planar configuration.
Figure 4B:
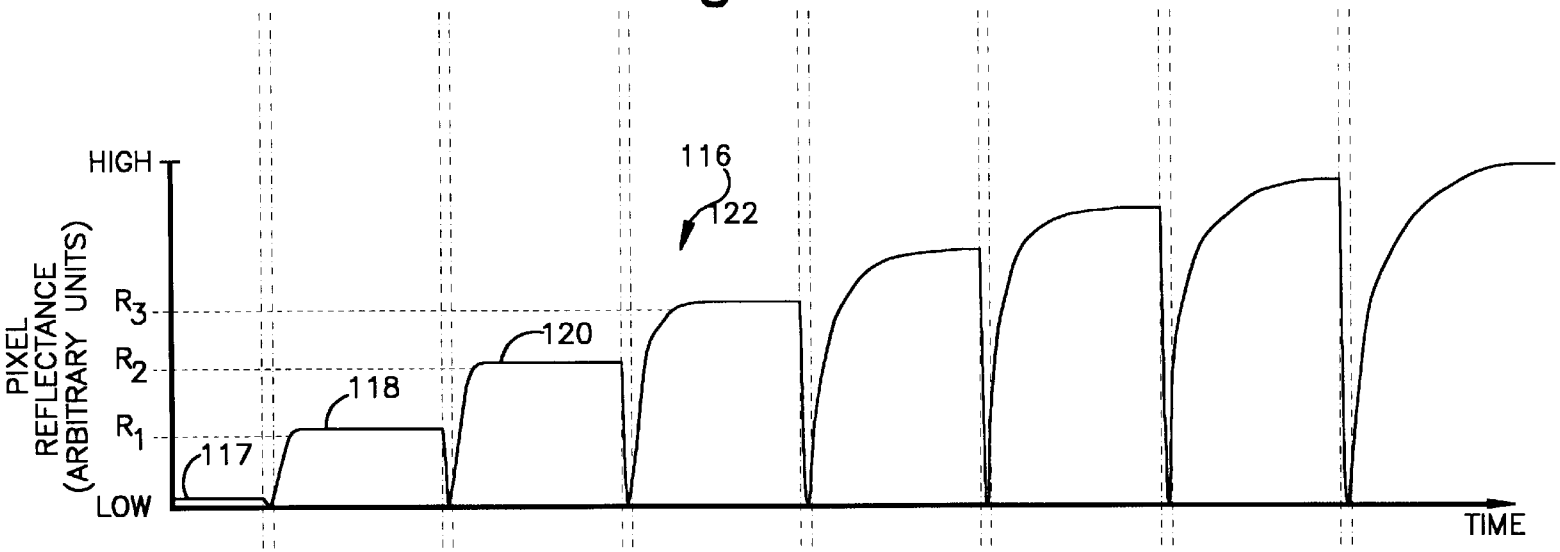
FIG. 4B is a schematic representation of the cumulative change in pixel reflectance as a function of time resulting from the application of the series of voltage pulses in FIG. 4A.
Figure 4D:
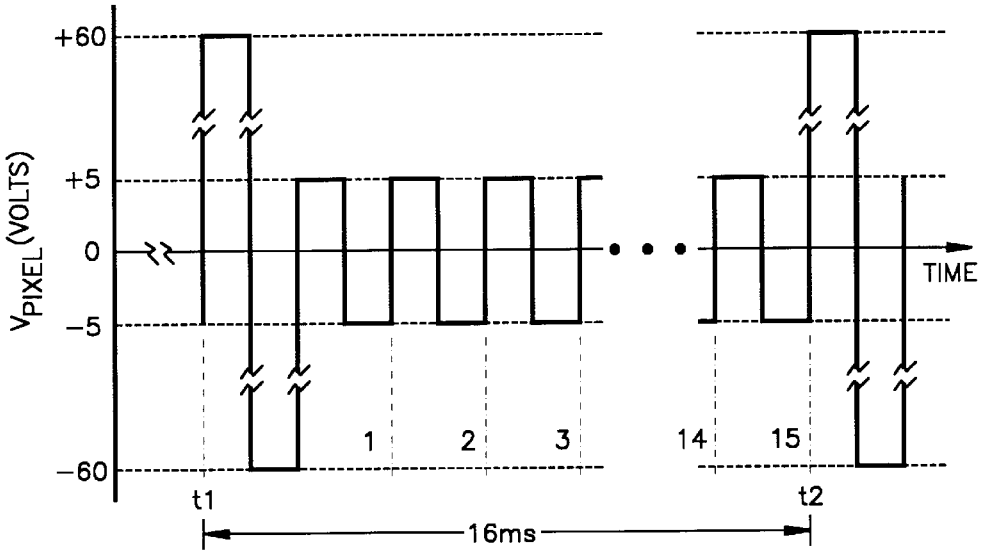
FIG. 4D is a schematic representation of two Von=±60 volt voltage pulses seperated by fifteen Vnonselect=±5 volt voltage pulses.

If a Von voltage of 60 volts rms is applied across a pixel for 1 ms., FIG. 4C provides a representation of the gradual change in reflectance of a pixel upon receiving three such 1 ms. voltage pulses. In a first application of Von for 1 ms. across the pixel, the transition path labeled 82*a* is followed to the point labeled 118 resulting in a reflectance state of R1 for the pixel. That is, a portion of the regions of the pixel have been converted to the planar configuration. In a second application of Von to the pixel, the transition path labeled 82*b* is followed to a point labeled 120 resulting in more regions being converted to the planar configuration and resulting in a higher pixel reflectance of R2. In a third application of Von to the pixel, the transition path labeled 82*c* is followed to a point labeled 122 with even more regions being converted to the planar configuration and resulting in a greater pixel reflectance of R3. The corresponding time vs. reflectance graph of this cumulative drive process is shown in FIG. 4B and will be discussed below. As can be seen in FIG. 4B, six or seven applications of Von are necessary to drive the pixel reflectance to a very high reflectance state.

Figure 5C:
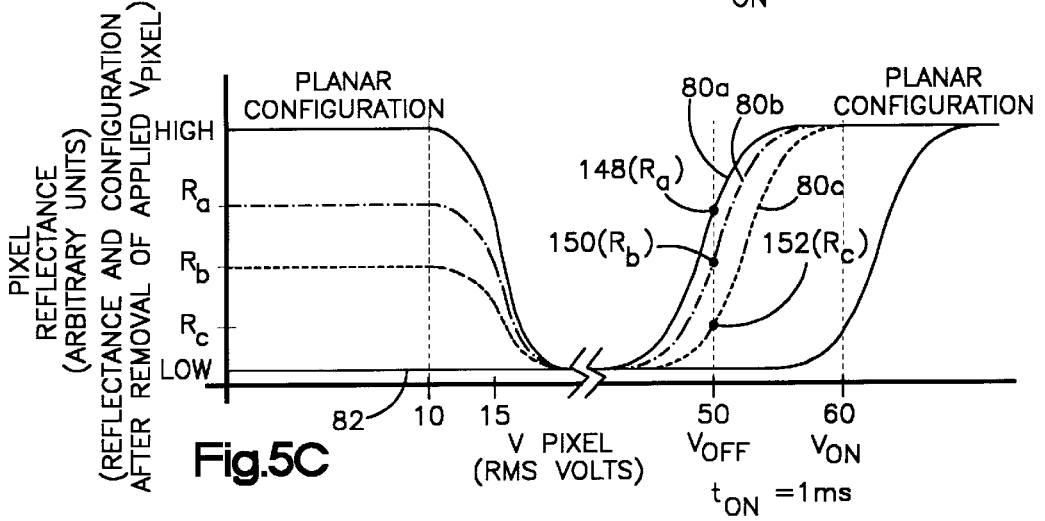
FIG. 5C is a schematic representation of the cumulative change in pixel reflectance from a high reflectance state to a low reflectance state resulting from short duration applications of a control voltage.
Figure 5A:
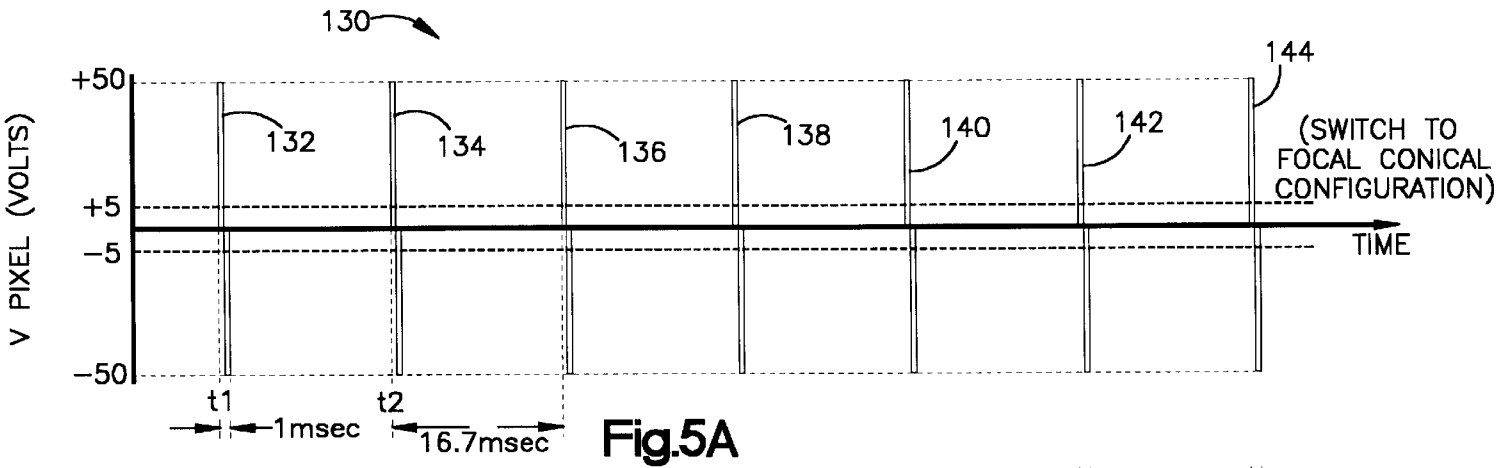
FIG. 5A is a schematic representation of a waveform as a function of time comprising a series of voltage pulses applied to a pixel to switch the pixel to a focal conical configuration.
Figure 5B:
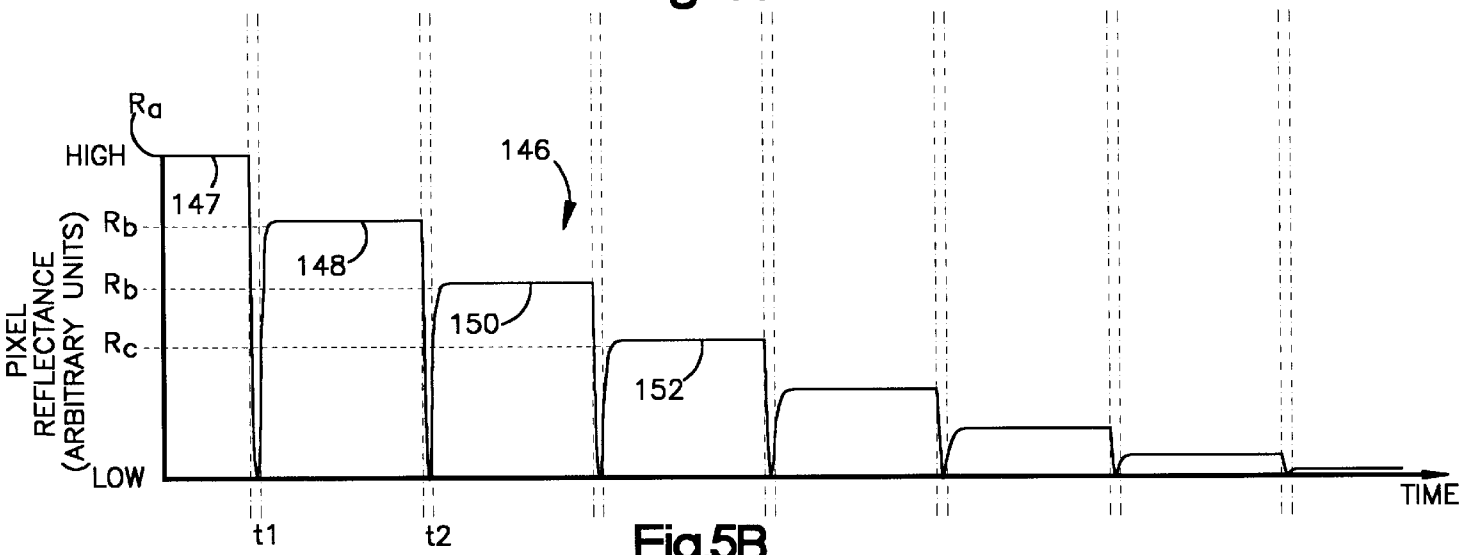
FIG. 5B is a schematic representation of the cumulative change in pixel reflectance as a function of time resulting from the application of the series of voltage pulses in FIG. 5A.

If a Voff voltage of 50 volts rms is applied across a pixel for 1 ms., FIG. 5C provides a representation of the gradual change in reflectance of a pixel upon receiving three such 1 ms. voltage pulses. In a first application of Voff for 1 ms. across the pixel, the transition path labeled 80*a* is followed to the point labeled 148 resulting in a reflectance state of Ra for the pixel. That is, a portion of the regions of the pixel have been converted to the focal conical configuration. In a second application of Voff to the pixel, the transition path labeled 80*b* is followed to a point labeled 150 resulting in more regions being converted to the focal conical configuration and resulting in a lower pixel reflectance of Rb. In a third application of Voff to the pixel, the transition path labeled 80*c* is followed to a point labeled 152 with even more regions being converted to the focal conical configuration and resulting in an even lower pixel reflectance of Rc. The corresponding time vs. reflectance graph of this cumulative drive process is shown in FIG. 5B and will be discussed below. As can be seen in FIG. 5B, six or seven applications of Voff are necessary to drive the pixel reflectance to a very low reflectance state.

It has been found that if the difference between Von and Voff is too great, an unacceptably low level of reflectance for the "on" pixels (pixels to be switched to the planar configuration) will result. Stated another way, if the difference between Von and Voff is too great for a pixel which is to be switched to the planar configuration, pixel reflectance will not rise to desired reflectance levels during periods when Vnonselect is applied across the pixel. For a passive matrix display, the formula that relates magnitudes of Von, Voff and Vnonselect is as follows:

$$Von - Voff = 2 \times Vnonselect$$

Figure 19:
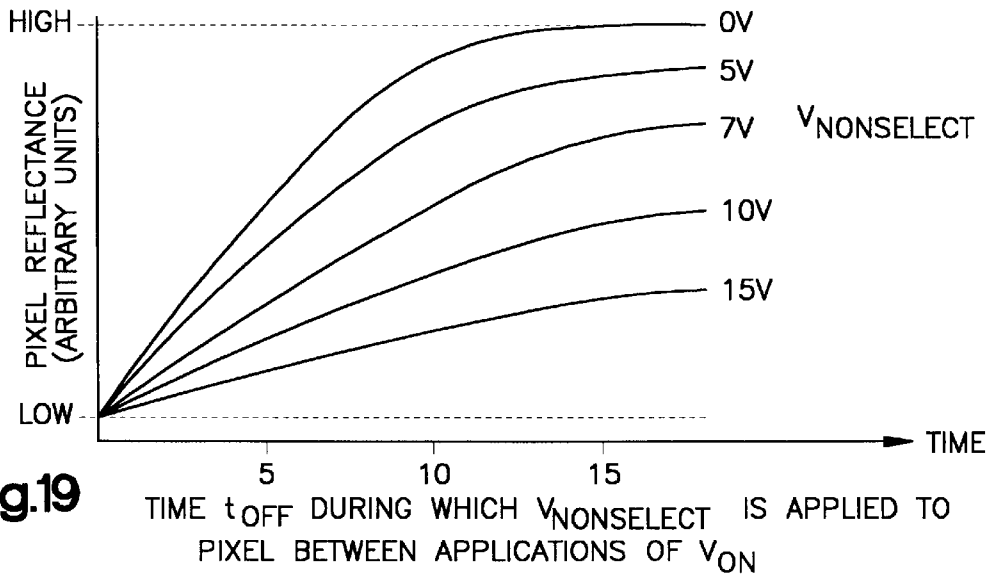
FIG. 19 is a schematic representation of a family of curves representing a range of nonselect interval pixel control voltages and a change in pixel reflectance as a function of time during which a nonselect interval pixel control voltage is applied.
Figure 18:
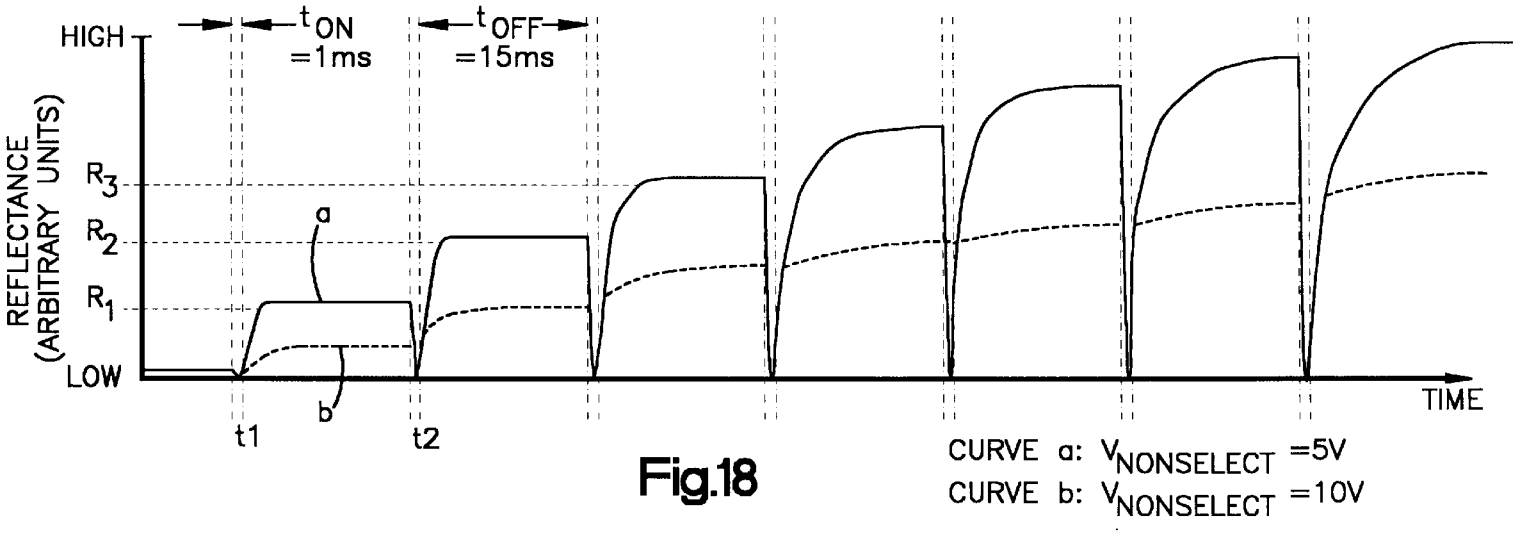
FIG. 18 is a schematic representation of differing rates of change of pixel reflectance depending on the control voltage applied to the pixel during nonselect intervals.

Turning to FIG. 19, a family of curves for different values of Vnonselect indicates that the higher magnitude of Vnonselect a pixel is subjected to between applications of Von control voltage pulses, the longer the total Von time needed to effect a change from a low reflectance state to a higher reflectance state for that pixel. FIG. 18 shows the reflectance state difference when Vnonselect=5 volts (solid line labeled "a") and when Vnonselect=10 volts (dashed line labeled "b") and a pixel is subjected to a series of seven Von pixel voltage applications of 60 volts rms for a time, ton=1 ms., wherein each application of ton is separated by applications of Vnonselect across the pixel for 15 ms. As can be seen in FIG. 18, with Vnonselect=5 volts rms, after seven Von voltage pulses the pixel has changed to the high reflectance state. With Vnonselect=10 volts rms, however, the pixel has still not reached the high reflectance state even after the application of seven Von voltage pulses. Thus, lower values of Vnonselect are more favorable for video rate compatible updating. Thus, the drive scheme of the present invention utilizes a ΔV of 10 volts rms and a Vnonselect of 5 volts rms.

It has been found that the cholesteric liquid crystal material 18 exhibits a strong accumulative effect with respect to changing configurations to upon application of multiple short duration voltage pulses to the material. As can be seen in FIGS. 4A and 4B, if a voltage waveform 100 is applied across the pixel pi,j as a control voltage, the pixel will switch from the low reflectance focal conical configuration to the high reflectance planar configuration as seen in FIG. 4B. The waveform 100 consists of a series of substantially square wave voltage pulses 102, 104, 106, 108, 110, 112, 114 of magnitude ±60 volts centered about zero volts and having a pulse width or duration of ton 2=1 ms. Preferably, the period, T2, or time between the positive going edges of successive pulses 102 is 16 ms. which corresponds to a frequency, f, of f=1/T=1/16 ms.=63 Hz. which approximately equals 60 Hz.

As can be seen from the plot of pixel reflectance at 116 in FIG. 4B. The pixel reflectance decreases during application of a given pulse and then increases after each pulse application, the largest increase in reflectance resulting from the first applied voltage pulse 102 and successively smaller increases in reflectance resulting from the application of subsequent voltage pulses 104, 106, 108, 110, 112, 114. After six to seven pulses, the pixel pi,j is saturated, that is, it is essentially entirely converted to the high reflectance planar configuration. The first voltage pulse 102 causes some regions or domains of cells in the pixel to move from the focal conical configuration to the homeotropic configuration. Recall that the homeotropic configuration exhibits low reflectance, but, upon removal of the electric field associated with the pulse 102, the regions in the homeotropic configuration relax to the high reflectance planar configuration. Thus, after the termination of the first pulse 102 at the time labeled t1, the pixel reflectance rises from a low reflectance level shown on by the graph portion 117 in FIG. 4B to an intermediate reflectance level 118 due to the planar configuration of the modified regions.

The application of the second voltage pulse 104 to the pixel pi,j converts additional regions in the pixel to the homeotropic configuration. Upon termination of the voltage pulse 104 at time t2, the pixel reflectance rises to a higher reflectance level shown by graph portion 120 in FIG. 4B. After six or seven pulses, the pixel pi,j is in the planar configuration., FIG. 4C is an enlarged view of a portion of FIG. 4*a* showing that the pixel pi,j is subject to a series of fifteen ±5 volt square wave pulses each having a duration of 1 ms. between application of each of the ±60 volt square wave voltage pulses.

The same accumulative effect is exhibited by the cholesteric liquid crystal material 18 changing from the high reflectance planar configuration to the low reflectance focal conical configuration. As can be seen in FIGS. 5A and 5B, if a voltage waveform 130 is applied across the pixel pi,j as a control voltage, the pixel pi,j will switch from the high reflectance planar configuration to the low reflectance focal conical configuration as seen in FIG. 5B. The waveform 130 consists of a series of substantially square wave voltage pulses 132, 134, 136, 138, 140, 142, 144 of magnitude ±50 volts centered about zero volts. The pluses have a pulse width or duration of ton1 1 ms and a period, T1, or time between the positive going edges of successive pulses 102 of 16 ms. (f=60 Hz.). The pixel pi,j is subject to a series of fifteen ±5 volt square wave pulses each having a duration of 1 ms. between application of each of the ±50 volt square wave voltage pulses.

As can be seen from the plot of pixel reflectance at 146 in FIG. 5B. The pixel reflectance decreases during application of each pulse then rebounds to a reflectance value that is less that the reflectance value before the application of the pulse. The largest decrease in reflectance results from the first applied voltage pulse 132 and successively smaller decreases in reflectance result from the application of subsequent voltage pulses 134, 136, 138, 140, 142, 144. After six to seven pulses, the pixel pi,j is saturated, that is, it is essentially entirely converted to the low reflectance focal conical configuration. The first voltage pulse 132, causes some regions or domains of cells in the pixel pi,j to move from the planar configuration to the focal conical configuration. Thus, after the start of the first pulse 132 at the time labeled t1 in FIGS. 5A and 5B, the pixel reflectance falls from a high reflectance level 147 to an intermediate reflectance level 148 due to the focal conical configuration of the modified regions.

The application of the second voltage pulse 134 to the pixel pi,j converts additional regions in the pixel to the focal conical configuration. Upon initiation of the voltage pulse 134 at time t2, the pixel reflectance falls to a lower reflectance level 150 in FIG. 5B. After six or seven pulses, the pixel pi,j is in the focal conical configuration.

The pulse width of ton=1 ms i.e. ton1 and ton2). and the period T of 16 ms. between ton pulse applications were selected such that each of the 16 rows of the pixel array 25 could be addressed or selected sequentially by the display driver circuitry 13 within the period (i.e. T1 or T2) T. Furthermore, the time required to change the state of a pixel from the reflectance to the non-reflectance state or vice versa will be on the order of 6 or 7 pulses. Thus, total updating time to change a given pixel pi,j will be on the order of 96 to 112 ms. (6×16 ms./pulse=96 ms. and 7×16 ms./pulse=112 ms.) Updating the video rate updating portion 10*a* of the display 10 every 16 ms. and changing pixel states in 96 to 112 ms. corresponds to a video rate, that is, the rate of change of pixels of the display 10 is rapid enough that the human eye will perceive image movement on the display 10 as being continuous where the image movement is relatively slow moving. Further, the frequency f=60 Hz. results in a non-flickering image on the display 10.

Figure 9:
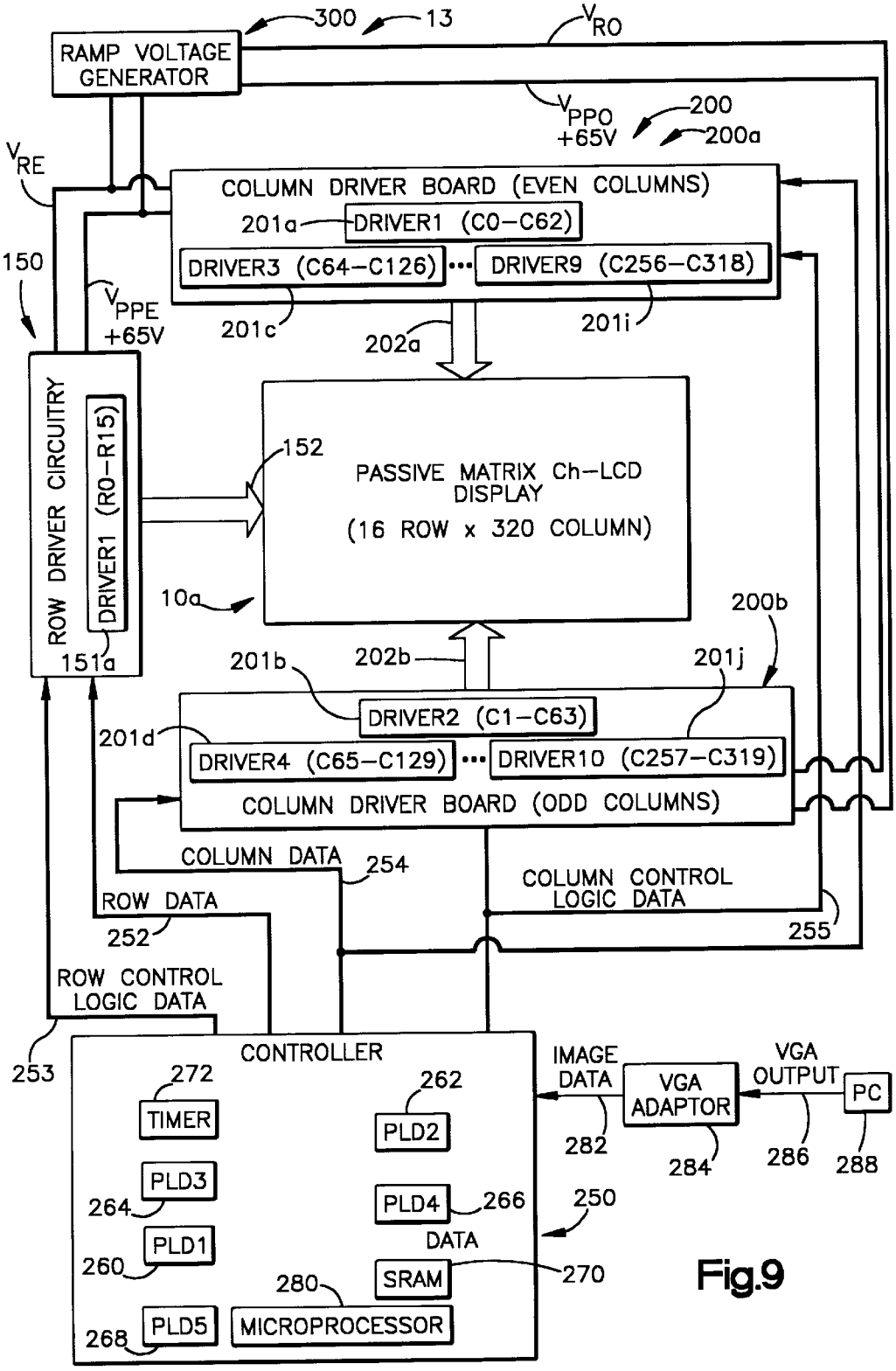
FIG. 9 is a schematic block diagram of selected circuitry of the unipolar driver circuitry for the video rate display portion of the flat-panel display.

Turning to FIG. 9, the display driver circuitry 13 of the present invention is electrically coupled to the row and column electrode segments 22, 24 and generates unipolar voltage pulses which when sychronized and applied to the column electrode segments 24 and a selected row electrode segment, say row electrode element Ri, results in the application of either a 1 ms. duration alternating square wave voltage pulse of ±60 volts or a 1 ms. duration alternating square wave voltage pulse of ±50 volts (as discussed with respect to FIGS. 4A and 5A) to the pixels in the selected row electrode segment Ri.

If a pixel, say pixel pi,j, is in the focal conical configuration (low reflectance state) and, because of a desired change of image on the display 10, needs to be changed to a planar configuration (high relectance state), the display driver circuitry 13 will apply the ±60 volt voltage pulse across the pixel pi,j. If the pixel pi,j is in the planar configuration (high reflectance state) and does not need to be changed, the display driver circuitry 13 will also apply the ±60 volt voltage pulse across the pixel pi,j.

If, on the other hand, the pixel pi,j, is in the planar configuration (high reflectance state) and, because of a desired change of image on the display 10, needs to be changed to a focal conical configuration (low relectance state), the display driver circuitry 13 will apply the ±50 volt voltage pulse across the pixel pi,j. If the pixel pi,j is in the focal conical configuration (low reflectance state) and does not need to be changed, the display driver circuitry 13 will also apply the ±50 volt voltage pulse across the pixel pi,j.

Unipolar Waveform Operating Embodiment

The display driver circuitry 13 is comprised of row driver circuitry 150 and column driver circuitry 200 mounted on a printed circuit board, a controller and associated circuitry mounted thereon 250 and a ramp voltage generator 300. Recall that each of the row electrode segments 22 has a contact or connector at the edge of the plate 54 and each of the column electrode segments 24 has a contact or connector at the edge of the plate 52 for coupling control voltages to the respective row and column electrode segments. The control/logic circuitry of the display driver circuitry 13 is incorporated in the controller (and associated circuitry) 250.

The row driver circuitry 150 is comprised of a single unipolar driver integrated circuit (IC) display driver 151*a* (hereinafter row driver 151*a*). The row driver 151*a* has 32 output channels and thus is capable of driving or updating 32 rows. A suitable row driver 151*a* is the Model No. HV623 display driver sold by Supertex of Sunnyvale, Calif. The Supertex HV623 display driver is a unipolar driver having an output range of 0–80 volts, 128 voltage levels and 32 output channels per chip. Sixteen of the 32 output channels of the row driver 151*a* are electrically coupled to the sixteen row electrode segments 22 via a suitable edge connection (shown schematically at 152 in FIG. 9). Similarly, the column driver circuitry 200 is mounted on column driver boards 201*a*, 201*b* and is comprised of ten unipolar display drivers (hereinafter column drivers 210*a*, 201*b*, . . . , 201*j*) such as the Supertex Model No. HV623. Each of the column drivers have their 32 output channels coupled to a different one of the 320 column electrode segments 24 via suitable edge connections (shown schematically at 202 in FIG. 9 and specifically at 202*a* for the even numbered column drivers 201*a*, 201*c*, . . . 201*i* and at 202*b* for the odd numbered column drivers 201*b*, 201*d*, . . . , 201*j*). As can be seen in FIG. 9, the column driver circuitry is separated onto two driver boards 200*a*, 200*b* having five column drivers each. The first board 200*a* of column driver circuitry 200 includes five column drivers that drive the even numbered electrode column segments (i.e., C0, C2, C4, . . . , C318), namely, driver1 201*a* (driving segments C0–C62), driver3 201*c* (driving segments C64–C126), . . . , driver9 201*i* (driving segments C256–C318). The second board 200*b* of column driver circuitry 200 includes five column drivers that drive the odd numbered electrode column segments (i.e., C1, C3, C5, . . . , C319), namely, driver2 201*b* (driving segments C1–C63), driver4 201*d* (driving segments C65–C127), . . . , driver10 201*j* (driving segments C257–C319).

The row and column driver circuitry 150, 200 is electrically connected to the controller 250 which includes circuitry that controls the presentation of data on the video rate updating portion 10*a* of the display 10 by controlling the reflectance state of each pixel in the array of pixels 25. The controller 250 also control the presentation on the static display portion 10*b*. Row data, row control logic data, column data and column control logic data from the controller 250 are presented to the row and column driver circuitry 150, 200 on buses 252, 253, 254, 255. The controller 250 also includes five programable logic devices PLD1 260, PLD2 262, PLD3 264, PLD4 266, PLD5 268, a static random access memory (SRAM) unit 270 and a timer 272. A microprocessor 280 controls operations of the circuitry on the controller 250. The controller 250 receives image data on a bus 282 from a VGA adapter 284. The VGA adapter 284, in turn, receives input on a bus 286 from a personal computer (pc) 288.

Figure 11:
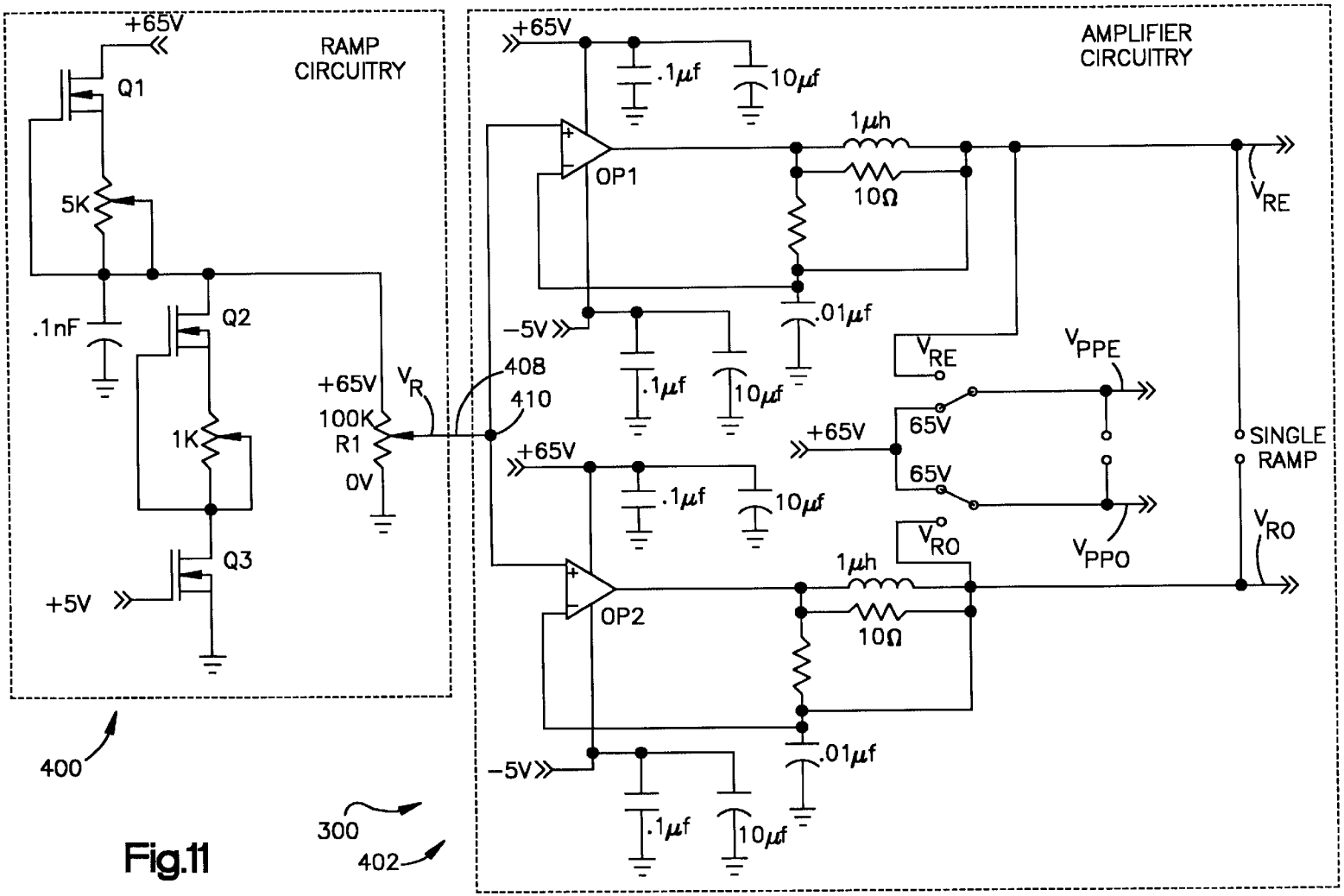
FIG. 11 is a schematic diagram of ramp generation circuitry utilized by unipolar driver circuitry of the present invention.

Coupled to the ramp voltage generator 300 are +5 and +65 volt DC input signals. The generator 300 produces ramped voltage outputs Vre and Vro having a magnitude of 0 to 60 volts at a frequency of f=62.5 kHz. (T=16 microseconds). As can be seen in FIG. 11, the ramp voltage generator 300 includes a ramp circuitry portion 400 and an amplifier circuitry portion 402. The ramp circuitry portion includes n-channel enhancement type MOSFET transitors Q1, Q2, Q3. The +65 volt DC signal is coupled to the drain of transistor Q1, while the +5 volt signal is input to the gate of Q3. The ramp circuitry 400 generates a ramp output voltage Vr having a magnitude range of 0 to 65 volts and a 16 microsecond ramp time at a wiper 408 of a 100 k ohm potentiometer R1. The ramp output voltage Vr 408 is coupled to the amplifier circuitry 402 at a node 410.

The ramp output voltage Vr is coupled to the noninverting input terminals of a pair of operational amplifiers OP1, OP2. The +65 volt supply is also coupled to the +V power supply terminal of each operational amplifier OP1, OP2, while a −5 volt supply is coupled to the −V power supply terminal of each operational amplifier. The output of the operational amplifier OP1 is a ramp output voltage Vre which is coupled to the row driver 151*a* and the five even numbered column drivers 201*a*, 201*c*, . . . , 201*i*. The output of the operational amplifier OP2 at a connector 418 which is coupled to the five odd numbered column column drivers 201*b*, 201*d*, . . . , 201*i*. The ramp voltage generator 300 also generates a +65 volt constant magnitude output Vppe which. is coupled to the row driver 151*a* and the even numbered column drivers 201*a*, 201*c*, . . . , 201*i*. Another +65 volt constant magnitude output Vppo is coupled to the odd numbered column drovers 201*b*, 201*d*, . . . , 201*j*.

As will be discussed below, the row and column driver circuitry 150, 200 generate unipolar voltage waveforms. When the unipolar voltage waveforms are synchronized and applied to the row electrode segments 22 and the column electrode segments 24, the waveforms combine to produce the ±60 volt alternating square wave voltage pulses and the ±50 volt alternating square wave voltage pulses applied across the pixels in the selected row as discussed previously.

The controller 250 sends a stream of data values to the row driver 151*a* along the bus 252. These data values correspond to desired voltage values to be output by row driver circuitry 150. Recall that the row driver 151*a* provides for 128 voltage level values. Thus, a voltage level value of 127 would cause the driver 151 to "clip" the voltage waveform input by the ramp voltage generator 300 at zero volts and generate a zero volt pulse as an output waveform. On the other hand, a voltage level value of 0 would cause the row driver 151*a* to permit the voltage waveform input by the ramp voltage generator 300 to rise to its maximum +60 volt value and generate a 60 volt pulse having a ramped portion and a constant voltage portion.

Figure 7:
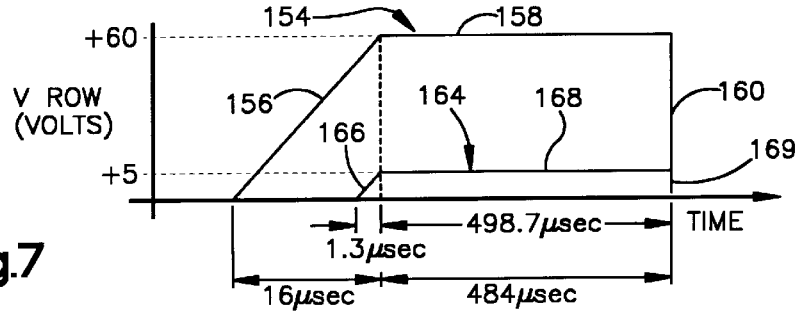
FIG. 7 is a representation of a ramp voltage output used to generate the series of pulses of different voltage magnitudes or levels of row and column drivers of FIG. 4.

A voltage pulse output of row driver 151*a* is schematically illustrated in FIG. 7 for two different output values, 60 volts and 5 volts, both of which, as will be explained below, are required from the row driver circuitry 150. It is required that the row driver circuitry 150 generate a 60 volt square wave of duration 0.5 ms. The controller 250 sends a data value of 128 over the bus 252 to the row driver circuitry 150. This data value causes the row driver 151*a* to allow a voltage waveform generated by the ramp voltage generator 300 to rise to its maximum value of 60 volts. The ramping from zero to 60 volts occurs in 16 microseconds.

The ouput waveform of the row driver 151*a* is shown at 154 in FIG. 7. The waveform 154 has a ramping up portion 156 which ramps from zero volts to positive 60 volts in 16 microseconds. Next, there is a uniform voltage portion 158 of the waveform 154 having a magnitude of +60 volt and a duration of 484 microseconds (16 micoseconds +486 microseconds=500 microseconds=0.5 ms. total waveform duration). Finally, the trailing edge 160 of the waveform drops the waveform voltage back to zero volts. Although the graph of the waveform 154 shown in FIG. 7 is not proportional to more clearly illustrate the the ramping portion 156, it should be appreciated that the waveform 154 is substantially a square wave voltage pulse of duration 0.5 ms. The ramping portion 156 accounts for only 16/500×100=3.2% of the waveform duration.

FIG. 7 also illustrates a voltage pulse output of row driver 151*a* for 5 volts. The VGA adapter logic board 250 sends an appropriate data value over the bus 252 to the row driver circuitry 150. This data value causes the row driver 151*a* to allow a voltage waveform generated by the ramp voltage generator 300 to rise to 5 volts and then clips it off. The ramping from zero to 5 volts occurs in 1.3 microseconds.

The ouput waveform of the row driver 151*a* is shown at 164 in FIG. 7. The waveform 164 has a ramping up portion 166 which ramps from zero volts to positive 60 volts in 1.3 microseconds. Next, there is a uniform voltage portion 168 of the waveform 154 having a magnitude of +5 volt and a duration of 498.7 microseconds (1.3 micoseconds +498.7 microseconds=500 microseconds=0.5 ms. total waveform duration). Finally, the trailing edge 169 of the waveform drops the waveform voltage back to zero volts. Here, the ramping portion 166 of the waveform 164 accounts for only 1.3/500×100=0.26% of the waveform duration. Thus, the waveform 164 is substantially a square wave voltage pulse of duration 0.5 ms.

Figure 6:
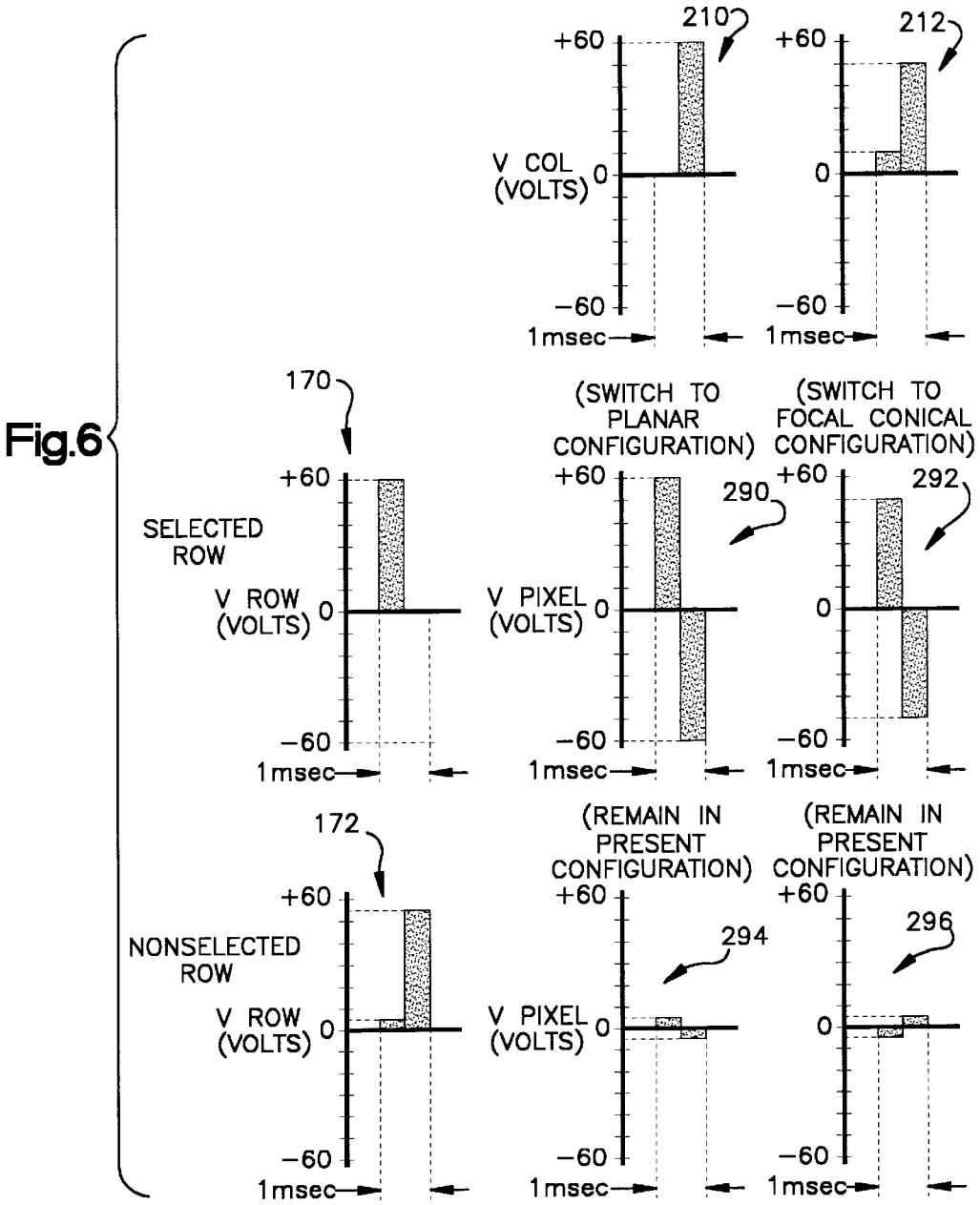
FIG. 6 is a representation of row and column driver circuitry waveforms generated by unipolar driver circuitry for causing a pixel to switch to the focal conical configuration, the planar configuration or to remain in its present configuration.

Control signals generated by the controller 250 and coupled to the row driver circuitry 150 via the bus 252 result in each of the sixteen row electrode segments 22 being sequentially selected or addressed from the bottom to the top of the display 10, that is in the order R0, R1, R2, . . . , R14, R15 as shown in FIG. 2D. When a row electrode segment Ri is addressed, the row segment Ri will be energized by the row driver circuitry 150 with a first unipolar waveform 170 (FIG. 6) having a duration of 1.0 ms. The remaining fifteen nonselected row electrode segments R0, R1, . . . , Ri−1, Ri+1, . . . , R15 will be in energized by the row driver circuitry 150 in sychronization with the energization of row Ri by a second unipolar waveform 172 (FIG. 6) also having a duration of 1.0 ms.

The controller 250 also synchonizes energization of the column electrode segments 24 with the energization of the row electrode segments 22. If a pixel pi,j associated with the intersection of selected row electrode segment Ri and column electrode segment Cj, is to be switched to the reflective planar configuration or is to remain in the planar configuration, the column driver circuitry 200, upon receiving appropriate column control and data from the controller 250, energizes the column Cj with a first unipolar waveform 210 (FIG. 6) having a duration of 1 ms. The combination of the first waveform 170 applied to the row segment Ri and the first waveform 210 applied to the column segment Cj create a ±60 volt alternating square wave control voltage pulse 290 across the pixel pi,j. The pulse 290 is similar in magnitude and duration to any one of the voltage pulses 102, 104, 106, 108, 110, 112, 114 discussed previously in connection with FIGS. 4A and 4B. Further, as discussed previously, the frequency of selecting any row electrode row Ri is f=60 Hz. As such, a pixel pi,j to be switched to the planar configuration or to remain in the planar configuration will be subjected to a series of ±60 volt voltage pulses as shown at 100 in FIG. 4A until such time as the pixel pi,j is to be switched to the non-reflective focal conical configuration.

If, on the other hand, the pixel pi,j associated with the intersection of selected row electrode segment Ri and column electrode segment Cj, is to be switched to the non-reflective focal conical configuration or is to remain in the focal conical configuration, the column driver circuitry 200, upon receiving approtriate column control and data from the controller 250, energizes the column Cj with a second unipolar waveform 212 (FIG. 6) having a duration of 1 ms. The combination of the first waveform 170 applied to the row segment Ri and the second waveform 212 applied to the column segment Cj create a ±50 volt alternating square wave control voltage pulse 292 across the pixel pi,j. The pulse 292 is similar in magnitude and duration to any one of the voltage pulses 132, 134, 136, 138, 140, 142, 144 discussed previously in connection with FIGS. 5A and 5B. A pixel pi,j to be switched to the focal conical configuration or to remain in the focal conical configuration will be subjected to a series of ±50 volt voltage pulses as shown at 130 in FIG. 5A until such time as the pixel pi,j is to be switched to the focal conical configuration.

For those pixels associated with the intersection of a nonselected row electrode segment (segments other than segment Ri) and a column electrode segment energized by the first column waveform 210, the resulting voltage pulse 294 (FIG. 6) across the pixel is a low voltage ±5 square wave "holding" pulse. The pulse 294 simply retains the pixel in its present configuration or, if the pixel is being changed from the focal conical configuration to planar configuration, the holding pulse 294 permits the homeotropic configuration regions to relax to the planar configuration. The ±5 volt "holding" pulse 294 is less than 15 volts (FIG. 3), so the existing pixel states (reflective and non-reflective) of the display 10 and specifically the video rate updating portion 10*a* will not be changed.

Finally, for those pixels associated with the intersection of a nonselected row electrode segment (segments other than segment Ri) and a column electrode segment energized by the second column waveform 212, the resulting voltage pulse 296 (FIG. 6) across the pixel is also a low voltage ±5 square wave "holding" pulse similar to the pulse 294 but opposite in phase or polarity. The pulse 296 simply retains the pixel in its present configuration or, if the pixel is being changed from the focal conical configuration to planar configuration, the holding pulse 296 permits the homeotropic configuration regions to relax to the planar configuration.

Returning again to FIG. 6, the first unipolar row waveform 170 generated by the row driver circuitry 150 and applied to the selected row electrode segment can be viewed as comprising two 0.5 ms. duration portions. The first portion of the waveform 170 has a magnitude of +60 volts, while the second portion has a magnitude of zero volts. The second unipolar row waveform 172 generated by the row driver circuitry 150 and applied to the non-selected row electrode segments also comprises two 0.5 ms. portions. The first portion has a magnitude of +5 volts, while the second portion has a magnitude of +55 volts.

Looking at the row of pixels corresponding to the selected row electrode segment Ri, namely, pi,a, pi,b, . . . , pi,j, . . . , pi,p, if a pixel pi,j, is to be changed to the reflective planar configuration or is to remain in the planar configuration, then the corresponding column electrode segment, Cj, of pi,j must be energized by the first unipolar column waveform 210. The first unipolar column waveform 210 is generated by the column driver circuitry 200 and can be viewed as comprising two 0.5 ms. duration portions. The first portion of the waveform 210 has a magnitude of zero volts, while the second portion has a magnitude of +60 volts. Since the application of the row and column waveforms 170, 172, 210, 212 is synchonized by the control/logic circuitry 350, the first portions and second portions of the waveforms 170 and 210 will occur in synchonization with the following results:

For the first 0.5 ms. portion, the pixel pi,j control voltage pulse will be:

V(pi,j)
=V(Ri)−V(Cj)
=+60v−0v
=+60v

For the second 0.5 ms. portion, the pixel pi,j control voltage pulse will be:

V(pi,j)
=V(Ri)−V(Cj)
=+0v−+60v
=−60v

If the pixel pi,j, is to be changed to the non-reflective focal conical configuration or is to remain in the focal conical configuration, then the corresponding column electrode segment, Cj, of pi,j must be energized by the second unipolar column waveform 212. The second unipolar column waveform 212 is generated by the column driver circuitry 200 and can be viewed as comprising two 0.5 ms. duration portions. The first portion of the waveform 212 has a magnitude of +10 volts, while the second portion has a magnitude of +50 volts. Since the application of the row and column waveforms 170, 172, 210, 212 is synchonized by the control/logic circuitry 250, the first portions and second portions of the waveforms 170 and 212 will occur in synchonization with the following results:

For the first 0.5 ms. portion, the pixel pi,j control voltage pulse will be:

V(pi,j)
=V(Ri)−V(Cj)
=+60v−+10v
+50v

For the second 0.5 ms. portion, the pixel pi,j control voltage pulse will be:

V(pi,j)
=V(Ri)−V(Cj)
=+0v−+50v
=−56v

As noted above, the second unipolar row waveform 172 is applied to the non-selected row electrode segments and can be viewed as comprising two 0.5 ms. duration portions. The first portion of the waveform 172 has a magnitude of +5 volts, while the second portion has a magnitude of +55 volts. If a pixel pi,j is associated with a non-selected row electrode segment and a column electrode segment having the first column waveform applied to the segment, then the pixel pi,j will be energized by the following control voltage pulse:

For the first 0.5 ms. portion, the pixel pi,j control voltage pulse will be:

V(pi,j)
=V(Ri)−V(Cj)
=+5v−0v
=+5v

For the second 0.5 ms. portion, the pixel pi,j control voltage pulse will be:

V(pi,j)
=V(Ri)−V(Cj)
=+55v−+60v
=−5v

If a pixel pi,j is associated with a non-selected row electrode segment and a column electrode segment having the second column waveform applied to the segment, then the pixel pi,j will be energized by the following contol voltage pulse:

For the first 0.5 ms. portion, the pixel pi,j control voltage pulse will be:

V(pi,j)
=V(Ri)−V(Cj)
=+5v−+10v
=−5v

For the second 0.5 ms. portion, the pixel pi,j control voltage pulse will be:

V(pi,j)
=V(Ri)−V(Cj)
+55v−+50v
=+5v

The waveforms 170, 172, 210, 212 choosen to generate the series of ±60 volt voltage pulses 290 to change a pixel to the planar configuration or to remain in the planar configuration and a series of ±50 volt voltage pulses 292 to change a pixel to the focal conical configuration or to remain in the focal conical configuration were selected because a magnitude of the difference between the resultant pulses 290 and 292 in the selected row electrode segment and between the resultant pulses 294 and 296 in the non-selected row electrode segments is a constant 5 volts. This voltage difference is within acceptable limits to minimize crosstalk between adjacent row and column electrode segments. Crosstalk occurs because of voltage differences between adjacent row electrode segments and voltage differences between adjacent column electrode segments. It has been empirically observed that voltage differences on the order of 10 volts are below levels that would result crosstalk amplitudes that would erase or change pixel states of the display 10.

Figure 14:
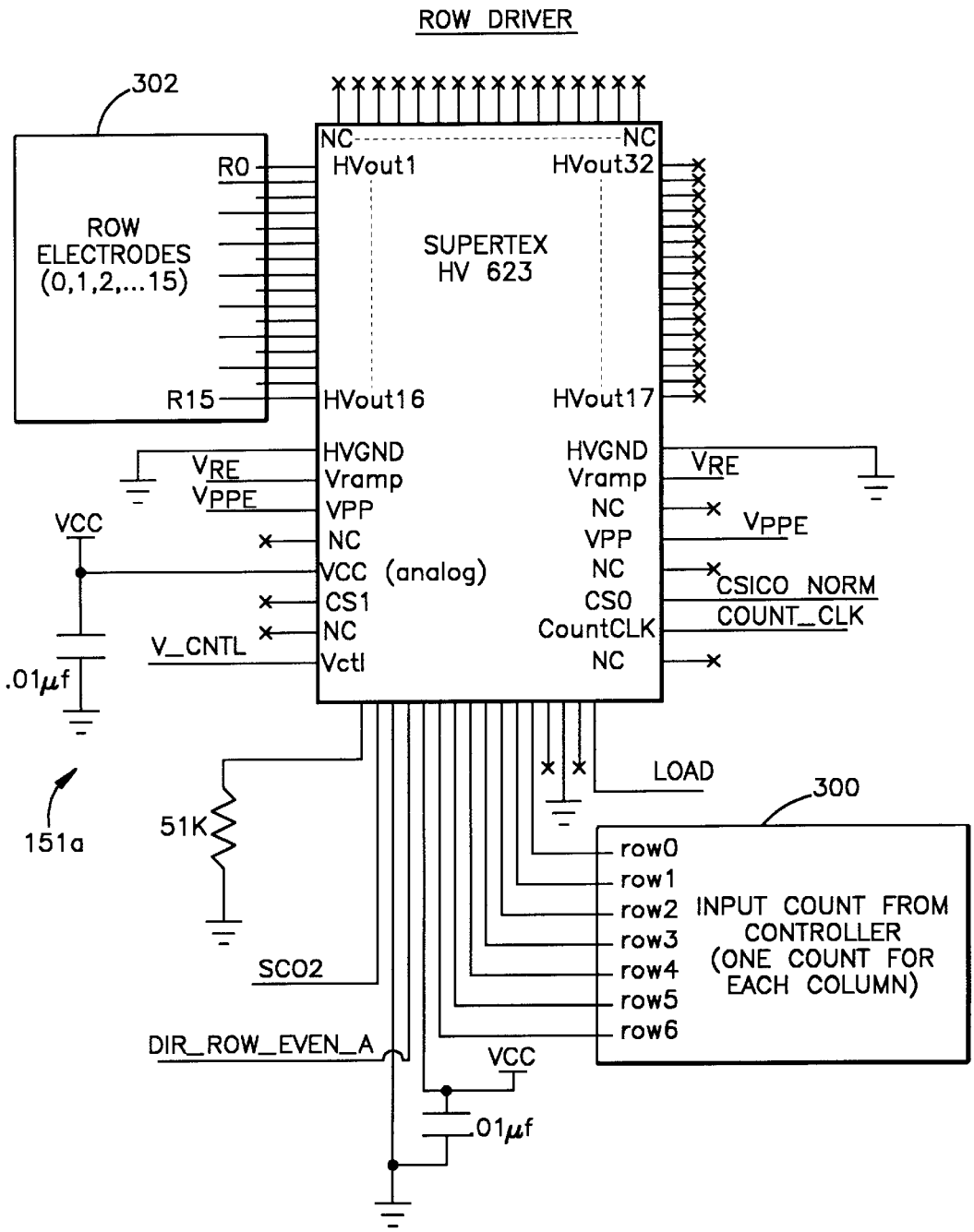
FIG. 14 is a schematic representation of a column driver integrated circuit for driving odd numbered columns of the video rate display portion of the flat-panel display of the present invention.

A schematic representation of the row driver 151*a* is shown in FIG. 14. As can be seen in the box labeled 300, the driver 151*a* receives a stream of seven bit binary "counts" from the controller 250 which correspond to the desired voltage level to be applied to a given row electrode segment Ri. The voltage level is on a scale of 0 to 127. The box labeled 302 shows the output of the driver 151*a* being coupled to individual row electrode segments R0–R15. The output 302 the driver 151*a* are voltage level values, one value for each of the row electrode segments.

Figure 12:
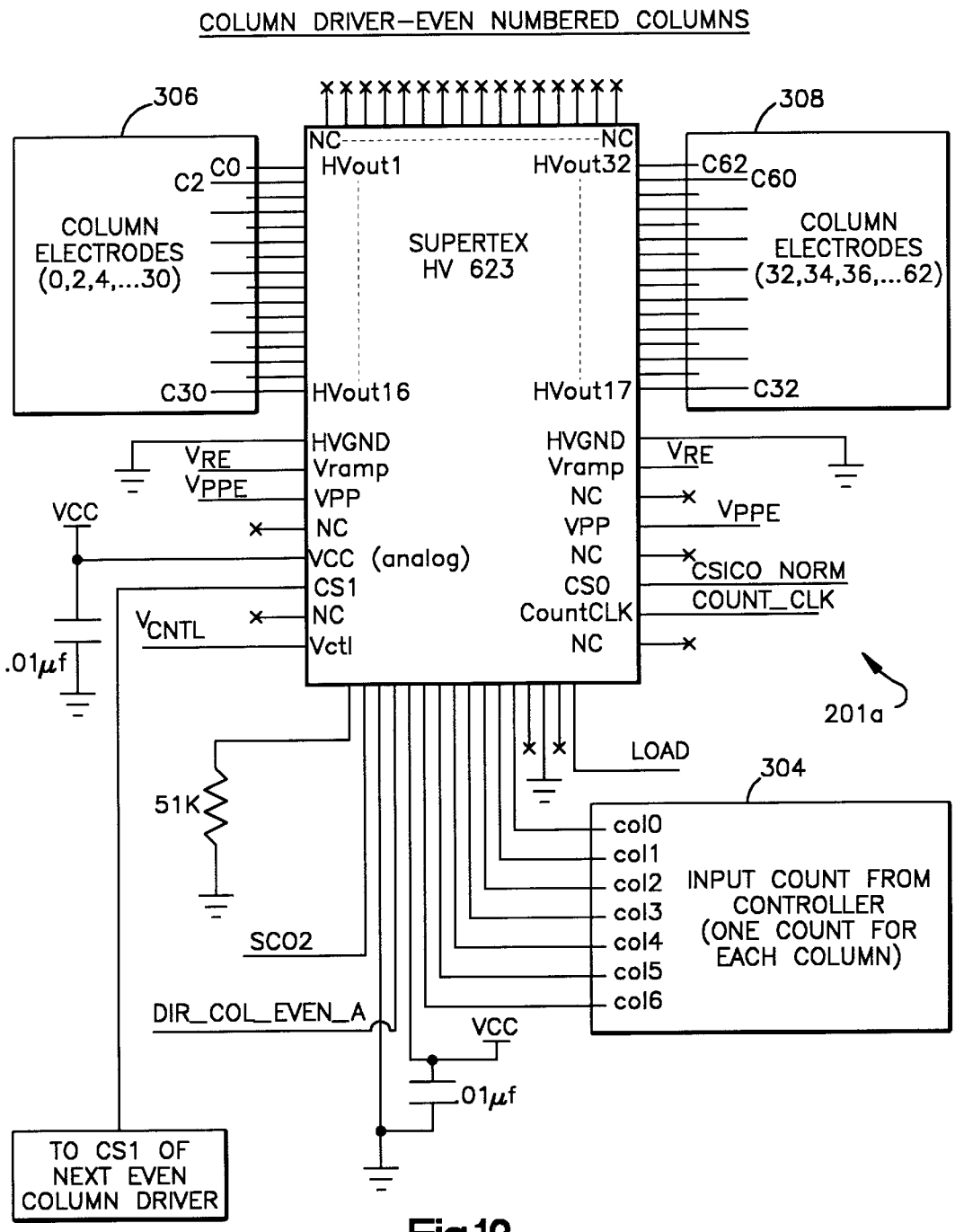
FIG. 12 is a schematic representation of a row driver integrated circuit for the flat-panel display of the present invention.

A schematic representation of a representative one of the column drivers 201*a* driving a set of even numbered columns is shown in FIG. 12. As can be seen in the box labeled 304, the driver 201*a* receives a stream of seven bit binary "counts" from the controller 250 which corresponds to a desired voltage level to be applied to a given even numbered column electrode segment Cj. The voltage level is on a scale of 0 to 127. The boxes labeled 306, 308 show the output of the driver 151*a* being coupled to individual even numbered column electrode segments C0–C62. The output 306, 308 of the driver 201*a* are voltage values, one value for each of the even numbered column electrode segments.

Figure 13:
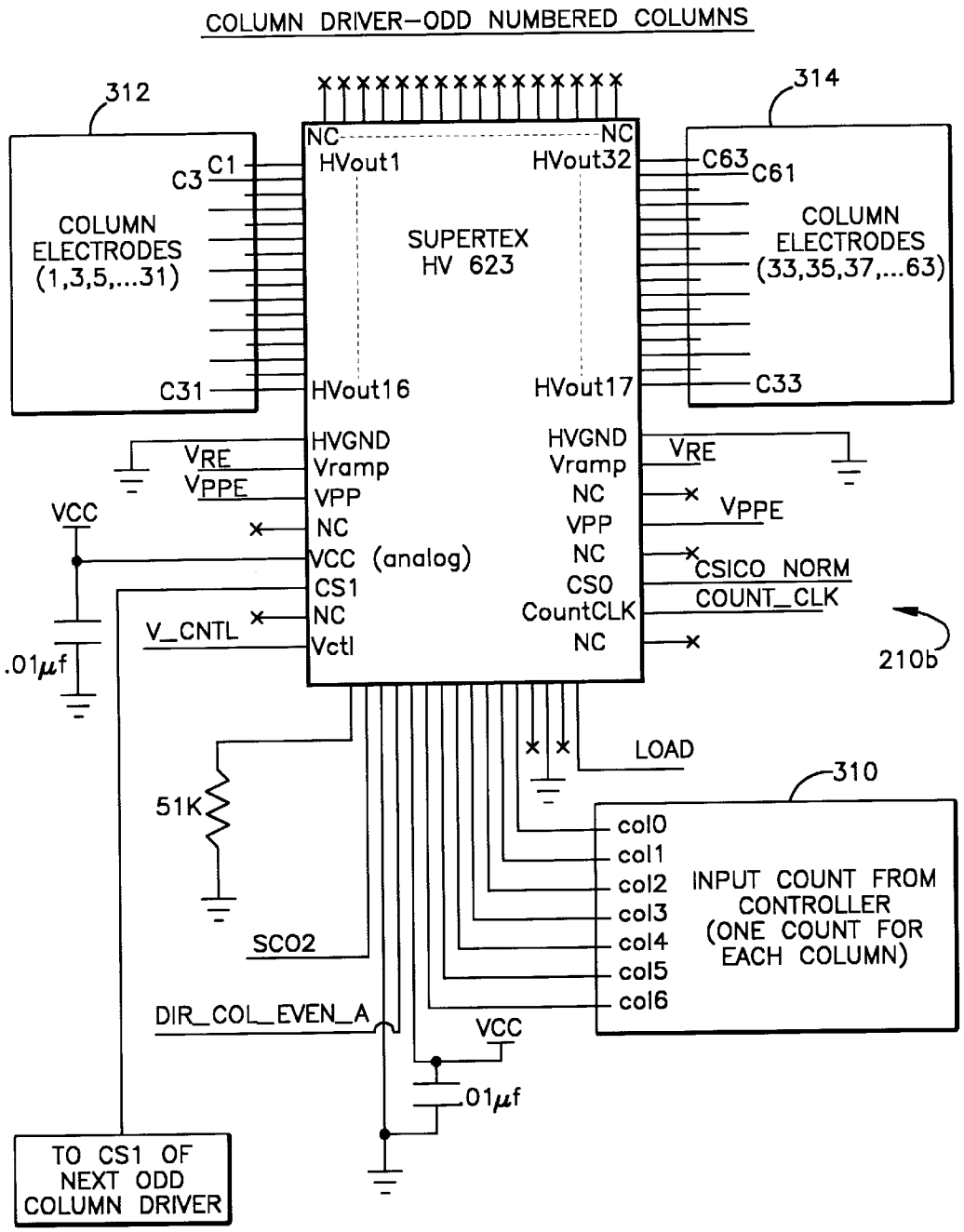
FIG. 13 is a schematic representation of a column driver integrated circuit for driving even numbered columns of the video rate display portion of the flat-panel display of the present invention.

A schematic representation of a representative one of the column drivers 201*b* driving a set of odd numbered columns is shown in FIG. 13. As can be seen in the box labeled 310, the driver 201*b* receives a stream of seven bit binary "counts" from the controller 250 which corresponds to a desired voltage level to be applied to a given odd numbered column electrode segment Cj. The voltage level is on a scale of 0 to 127. The boxes labeled 312, 314 show the output of the driver 151*b* being coupled to individual odd numbered column electrode segments C1–C63. The output 312, 314 of the driver 201*b* is a succession of voltage level values, one value for each of the even numbered column electrode segments.

Bipolar Waveform Operating Embodiment

Figure 8:
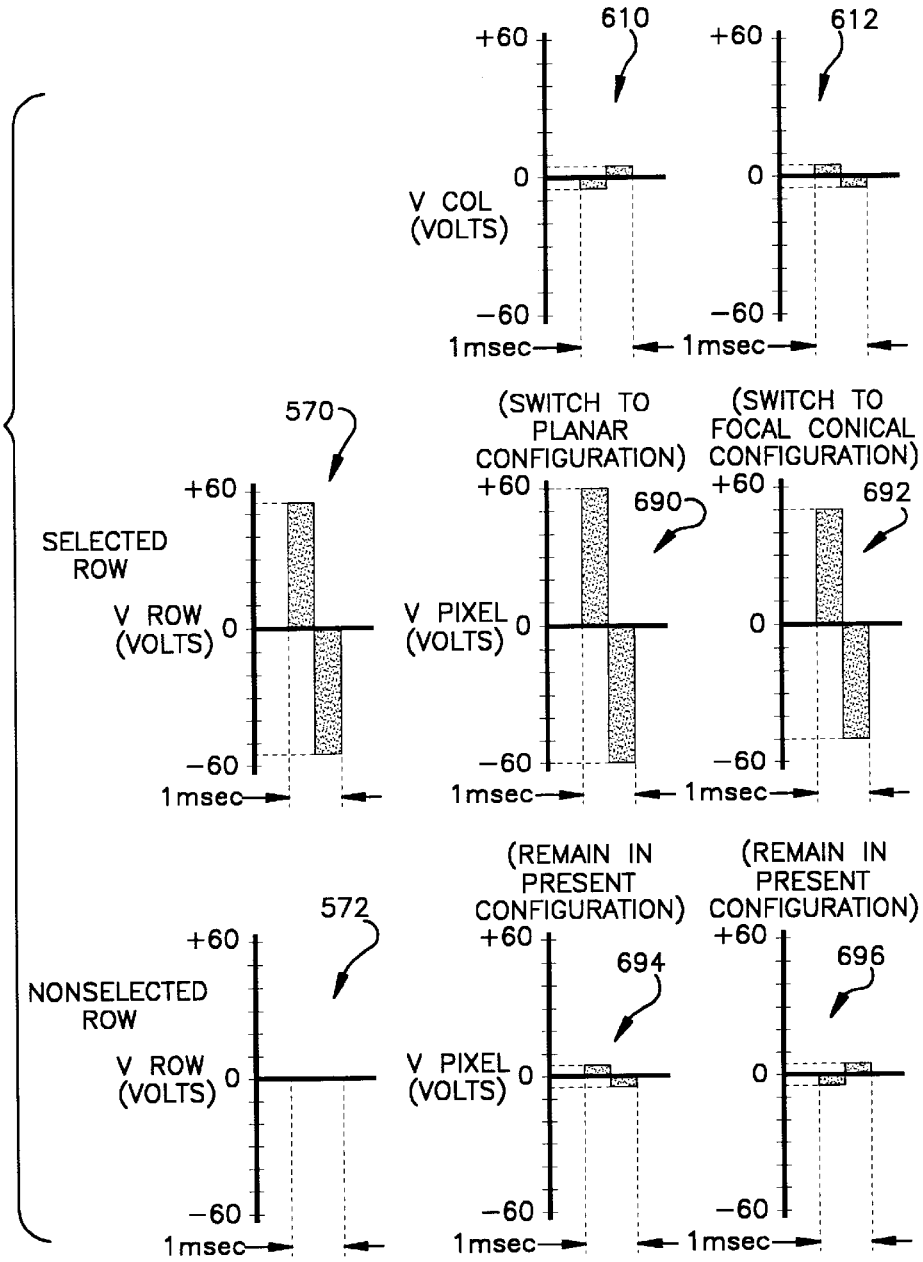
FIG. 8 is a representation of row and column driver circuitry waveforms generated by bipolar driver circuitry for causing a pixel to switch to the focal conical configuration, the planar configuration or to remain in its present configuration.
Figure 10:
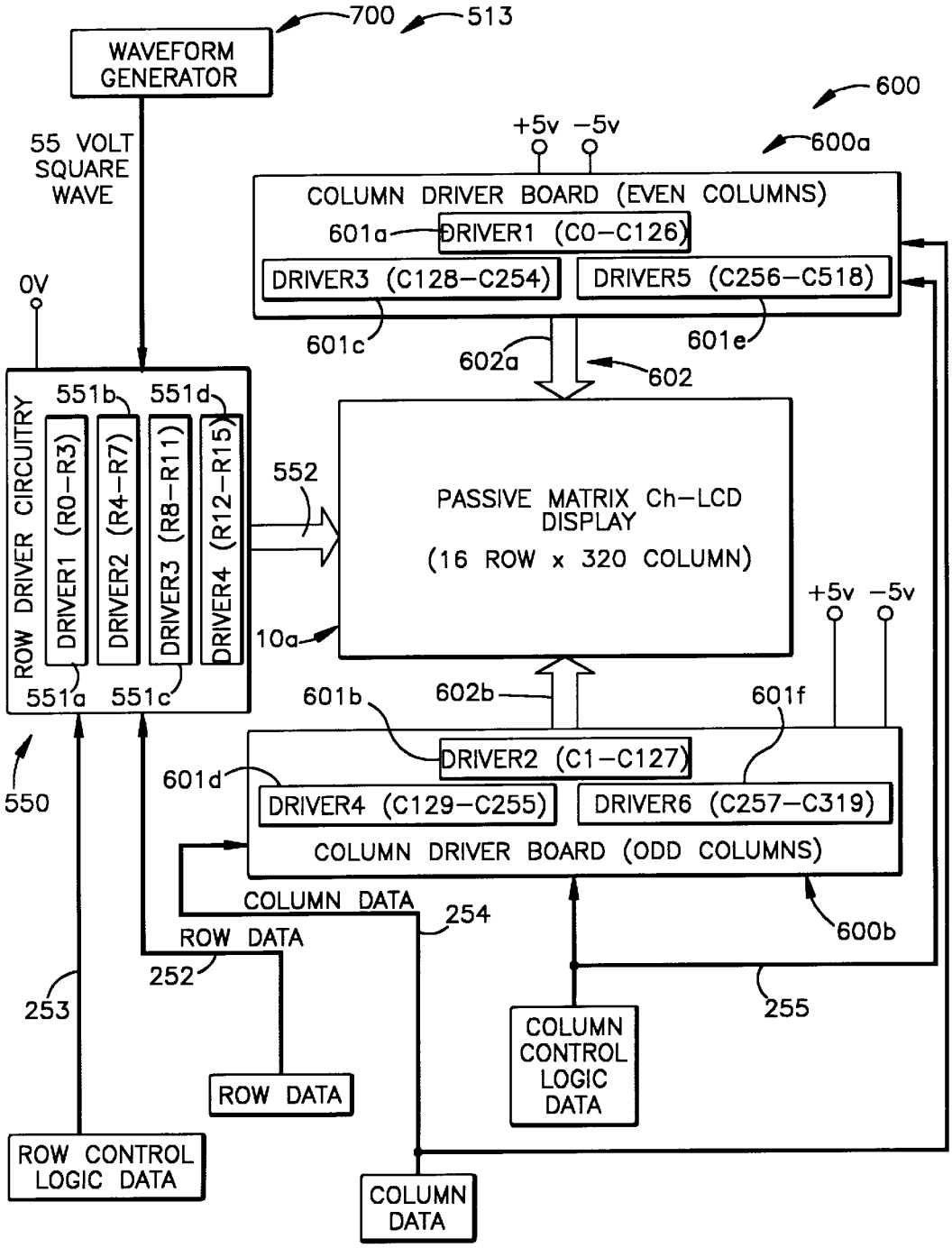
FIG. 10 is a schematic block diagram of selected circuitry of bipolar driver circuitry for the video rate display portion of the flat-panel display.

Aspects of a second operating embodiment of the display 10 of the present invention is shown in FIGS. 8 and 10. In this operating embodiment, bipolar, as opposed to unipolar, waveforms are generated by the row and column driver circuitry. Reference numbers used in describing the first operating embodiment will be used to identify components do not change between the first and second operating embodiments. The viewer 12 (not shown) and the display 10 (a portion of which is shown schematically in FIG. 10) are identical to the components described above. As in the first operating embodiment, the display 10 includes a video rate updating portion 10*a* and a static rate updating portion 10*b*.

The viewer 12 supports display driver circuitry 513 (FIG. 10) coupled to the display 10 to energize the display such that a desired image is displayed. As in the first operating embodiment, only that portion of the display driver circuitry 513 relating to the 16 row by 320 column video rate updating portion 10*a* of the display 10 is illustrated in FIG. 10 and discussed herein. The display driver circuitry 513 is electrically coupled to the row and column electrode segments (not shown but identical to the row and column electrode segments 22, 24 discussed above) and generates bipolar voltage pulses which when sychronized and applied to the column electrode segments 24 and a selected row electrode segment Ri results in the application of either a 1 ms. duration alternating square wave voltage pulse of ±60 volts or a 1 ms. duration alternating square wave voltage pulse of ±50 volts (as discussed with respect to FIGS. 4A and 5A) to the pixels in the selected row electrode segment Ri.

The display driver circuitry 513 is comprised of row driver circuitry 550 mounted on a row driver board and column driver circuitry 600 mounted on two column driver boards, a controller (not shown but similar to the controller 250 described with respect to the first operating embodiment) and a waveform generator 700. The controller produces row data and row control logic data coupled to the row driver circuitry 550 via the buses 252, 253 and column data and column control logic data coupled to the column driver circuitry 600 via the buses 254, 255. The row driver circuitry 550 is comprised of four bipolar driver IC analog switches 551*a*, 551*b*, 551*c*, 551*d*, each capable of servicing four row segment electrodes 22. A suitable row driver is the Model No. HV20420 analog switch sold by Supertex. The Supertex HV20420 analog switch has an output range of −80 to +80 volts. The four row drivers 551*a*, 551*b*, 551*c*, 551*d* are electrically coupled to the sixteen row electrode segments 22 via suitable connections (shown schematically at 552 in FIG. 10). Similarly, the column driver circuitry 600 is comprised of six bipolar STN drivers 601 (hereinafter column drivers 601*a*, 601*b*, 601*c*, 601*d*, 601*e*, 601*f*) such as the S-MOS SED1191F sold by S-MOS Corporation of Japan. To achieve a bipolar output, the output of the drivers 601 is floated above ground.

Each of the six column drivers 601*a*, 601*b*, 601*c*, . . . , 601*f* have 64 output channels coupled to respective different ones of the 320 column electrode segments 24 via suitable connections (shown schematically at 602 in FIG. 10 and specifically at 602*a* for the even numbered column drivers 601*a*, 601*c*, 601*e* and at 602*b* for the odd numbered column drivers 601*b*, 601*d*, 601*f*). As can be seen in FIG. 10, the column driver circuitry 600 is separated into two sets 600*a*, 600*b* of three drivers. The first set 600*a* of column driver circuitry 600 comprises three column drivers that drive the even numbered electrode column segments (i.e., C0, C2, C4, . . . , C318), namely, drivern 601*a* (driving segments C0–C126), driver3 601*c* (driving segments C128–C254), drivers 601*e* (driving segments C256–C318). The second set 600*b* of column driver circuitry 600 comprises three column drivers that drive the odd numbered electrode column segments (i.e., C1, C3, C5, . . . , C319), namely, driver2 601*b* (driving segments C1–C127), driver4 601*d* (driving segments C129–C255), . . . , driver6 601*f* (driving segments C257–C319).

The row and column driver circuitry 550, 600 is electrically connected to the controller 250 which controls the presentation of data on the display 10 by controlling the reflectance state of each pixel in the array of pixels 25. Row data signals from the controller for the row driver circuitry 550 are presented on the data bus 252 while column data signals from the controller for the column driver circuitry 600 are presented on the data bus 254. Row control logic data signals from the controller for the row driver circuitry 550 are presented on the data bus 253 while column control logic data signals from the controller for the column driver circuitry 600 are presented on the data bus 255.

Coupled to the waveform generator 700 are +55 and −55 volt DC inputs. The generator 700 produces ±55 volt alternating square wave voltage output 706 at a frequency of f=62.5 kHz. (T=16 microseconds). The square wave voltage output 706, in turn, is coupled to the row drivers 551*a*, 551*b*, 551*c*, 551*d* of the row driver circuitry 550. The column drivers 601*a*, 601*b*, . . . , 601*f* of the column driver circuitry 600 is coupled to +5 volt and −5 volt DC inputs. As will be discussed below, the row and column driver circuitry 550, 600 generate bipolar voltage waveforms. When the bipolar voltage waveforms are synchronized and applied to the row electrode segments 22 and the column electrode segments 24, the waveforms combine to produce the ±60 volt alternating square wave voltage pulses and the ±50 volt alternating square wave voltage pulses applied across the pixels in the selected row Ri as discussed previously.

Row control logic data signals generated by the controller coupled to the row driver circuitry 550 result in each of the sixteen row electrode segments 22 being sequentially selected or addressed from the bottom to the top of the video updating display portion 10*a*, that is in the order R0, R1, R2, . . . , R14, R15 as shown in FIG. 2D. When a row electrode segment Ri is addressed, the row segment Ri will be energized by the row driver circuitry 550 with a first bipolar waveform 570 (FIG. 8) having a duration of 1.0 ms. The remaining fifteen nonselected row electrode segments R0, R1, . . . , Ri−1, Ri+1, . . . , R15 are not energized as shown at 572 in FIG. 8.

The controller 250 also synchonizes energization of the column electrode segments 24 with the energization of the row electrode segments 22. If a pixel pi,j associated with the intersection of selected row electrode segment Ri and column electrode segment Cj, is to be switched to the reflective planar configuration or is to remain in the planar configuration, the column driver circuitry 600, upon receiving appropriate column control and data from the controller, energizes the column Cj with a first bipolar waveform 610 (FIG. 8) having a duration of 1 ms. The combination of the first waveform 570 applied to the row segment Ri and the first waveform 610 applied to the column segment Cj create a ±60 volt alternating square wave control voltage pulse 690 across the pixel pi,j. The pulse 690 is similar in magnitude and duration to any one of the voltage pulses 102, 104, 106, 108, 110, 112, 114 discussed previously in connection with FIGS. 4A and 4B. Further, as discussed previously, the frequency of selecting any row electrode row Ri is f=60 Hz. As such, a pixel pi,j to be switched to the planar configuration or to remain in the planar configuration will be subjected to a series of ±60 volt voltage pulses as shown at 100 in FIG. 4A until such time as the pixel pi,j is to be switched to the non-reflective focal conical configuration.

If, on the other hand, the pixel pi,j associated with the intersection of selected row electrode segment Ri and column electrode segment Cj, is to be switched to the non-reflective focal conical configuration or is to remain in the focal conical configuration, the column driver circuitry 600, upon receiving appropriate column data from the controller 250 energizes the column Cj with a second unipolar waveform 612 (FIG. 8) having a duration of 1 ms. The combination of the first waveform 570 applied to the row segment Ri and the second waveform 612 applied to the column segment Cj create a ±50 volt alternating square wave control voltage pulse 692 across the pixel pi,j. The pulse 692 is similar in magnitude and duration to any one of the voltage pulses 132, 134, 136, 138, 140, 142, 144 discussed previously in connection with FIGS. 5A and 5B. A pixel pi,j to be switched to the focal conical configuration or to remain in the focal conical configuration will be subjected to a series of ±50 volt voltage pulses as shown at 130 in FIG. 5A until such time as the pixel pi,j is to be switched to the focal conical configuration.

For those pixels associated with the intersection of a nonselected row electrode segment (segments other than segment Ri) and a column electrode segment energized by the first column waveform 610, the resulting voltage pulse 694 (FIG. 8) across the pixel is a low voltage ±5 square wave "holding" pulse. The pulse 694 simply retains the pixel in its present configuration or, if the pixel is being changed from the focal conical configuration to planar configuration, the holding pulse 694 permits the homeotropic configuration regions to relax to the planar configuration. The ±5 volt "holding" pulse 694 is less than 15 volts (FIG. 3), so the existing pixel states (reflective and non-reflective) of the display 10 will not be changed.

Finally, for those pixels associated with the intersection of a nonselected row electrode segment (segments other than segment Ri) and a column electrode segment energized by the second column waveform 612, the resulting voltage pulse 696 (FIG. 6) across the pixel is also a low voltage ±5 square wave "holding" pulse similar to the pulse 694 but opposite in phase or polarity. The pulse 696 simply retains the pixel in its present configuration or, if the pixel is being changed from the focal conical configuration to planar configuration, the holding pulse 696 permits the homeotropic configuration regions to relax to the planar configuration.

Returning again to FIG. 8, the first bipolar row waveform 570 generated by the row driver circuitry 550 and applied to the selected row electrode segment can be viewed as comprising two 0.5 ms. duration portions. The first portion of the waveform 570 has a magnitude of +55 volts, while the second portion has a magnitude of −55 volts. The "waveform" 572 has zero volts magnitude as noted above.

Looking at the row of pixels corresponding to the selected row electrode segment Ri, namely, pi,a, pi,b, . . . , pi,j, . . . , pi,p, if a pixel pi,j, is to be changed to the reflective planar configuration or is to remain in the planar configuration, then the corresponding column electrode segment, Cj, of pi,j must be energized by the first bipolar column waveform 610. The first bipolar column waveform 610 is generated by the column driver circuitry 600 and can be viewed as comprising two 0.5 ms. duration portions. The first portion of the waveform 610 has a magnitude of −5 volts, while the second portion has a magnitude of +5 volts. Since the application of the row and column waveforms 570, 610, 612 is synchonized by the controller 250, the first portions and second portions of the waveforms 570 and 610 will occur in synchonization with the following results:

For the first 0.5 ms. portion, the pixel pi,j control voltage pulse will be:

V(pi,j)
=V(Ri)−V(Cj)
=+55v−−5v
=+60v

For the second 0.5 ms. portion, the pixel pi,j control voltage pulse will be:

V(pi,j)
=V(Ri)−V(Cj)
=−55v−+5v
=−60v

If the pixel pi,j, is to be changed to the non-reflective focal conical configuration or is to remain in the focal conical configuration, then the corresponding column electrode segment, Cj, of pi,j must be energized by the second unipolar column waveform 612. The second unipolar column waveform 612 is generated by the column driver circuitry 600 and can be viewed as comprising two 0.5 ms. duration portions. The first portion of the waveform 612 has a magnitude of +5 volts, while the second portion has a magnitude of −5 volts. Since the application of the row and column waveforms 570, 572, 610, 612 is synchonized by the controller 250, the first portions and second portions of the waveforms 570 and 612 will occur in synchonization with the following results:

For the first 0.5 ms. portion, the pixel pi,j control voltage pulse will be:

V(pi,j)
=V(Ri)−V(Cj)
=+55v−+5v
=+50v

For the second 0.5 ms. portion, the pixel pi,j control voltage pulse will be:

V(pi,j)
=V(Ri)−V(Cj)
=−55v−−5v
=−50v

As noted above, the second unipolar row "waveform" 572 has zero magnitude. If a pixel pi,j is associated with a non-selected row electrode segment and a column electrode segment having the first column waveform 610 applied to the segment, then the pixel pi,j will be energized by the following contol voltage pulse:

For the first 0.5 ms. portion, the pixel pi,j control voltage pulse will be:

V(pi,j)
=V(Ri)−V(Cj)
=+0v−−5v
=+5v

For the second 0.5 ms. portion, the pixel pi,j control voltage pulse will be:

V(pi,j)
=V(Ri)−V(Cj)
=+0v−+5v
=−5v

If a pixel pi,j is associated with a non-selected row electrode segment and a column electrode segment having the second column waveform 612 applied to the segment, then the pixel pi,j will be energized by the following contol voltage pulse:

For the first 0.5 ms. portion, the pixel pi,j control voltage pulse will be:

V(pi,j)
=V(Ri)−V(Cj)
=+0v−+5v
=−5v

For the second 0.5 ms. portion, the pixel pi,j control voltage pulse will be:

V(pi,j)
=V(Ri)−V(Cj)
=+0v−−5v
=+5v

First Alternate Embodiment—Dual Row Driver Configuration

Figure 15:
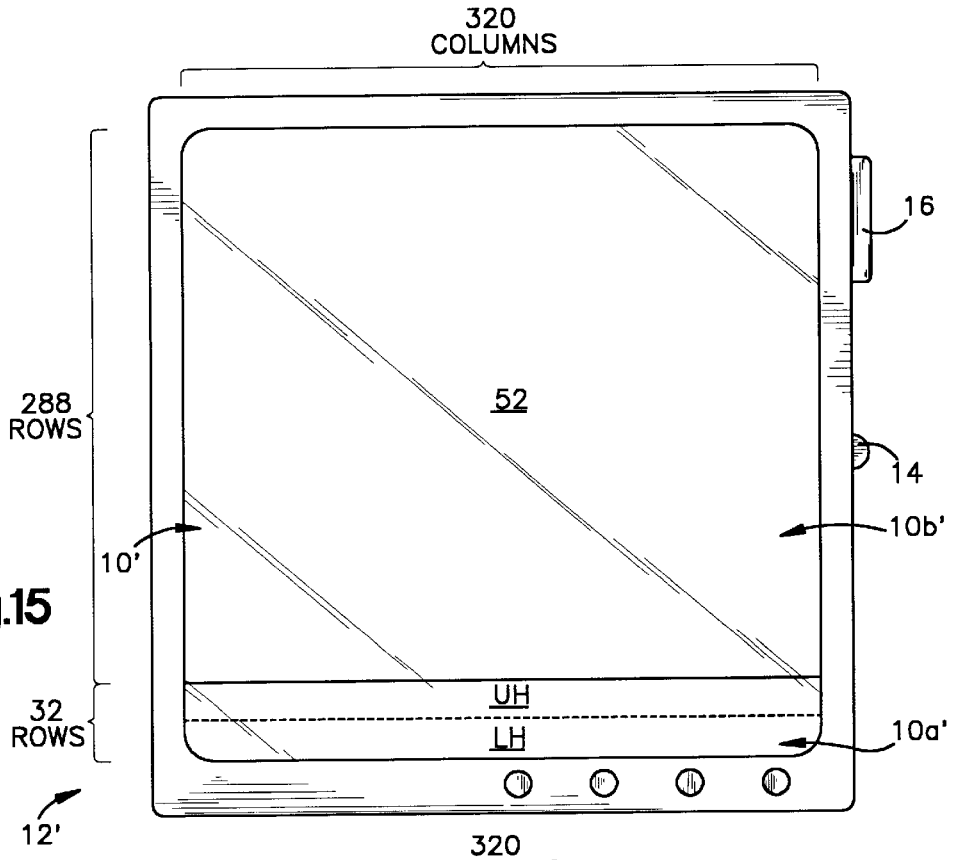
FIG. 15 is a top plan view of an alternate embodiment of a flat panel liquid crystal display of the present invention.
Figure 15A:
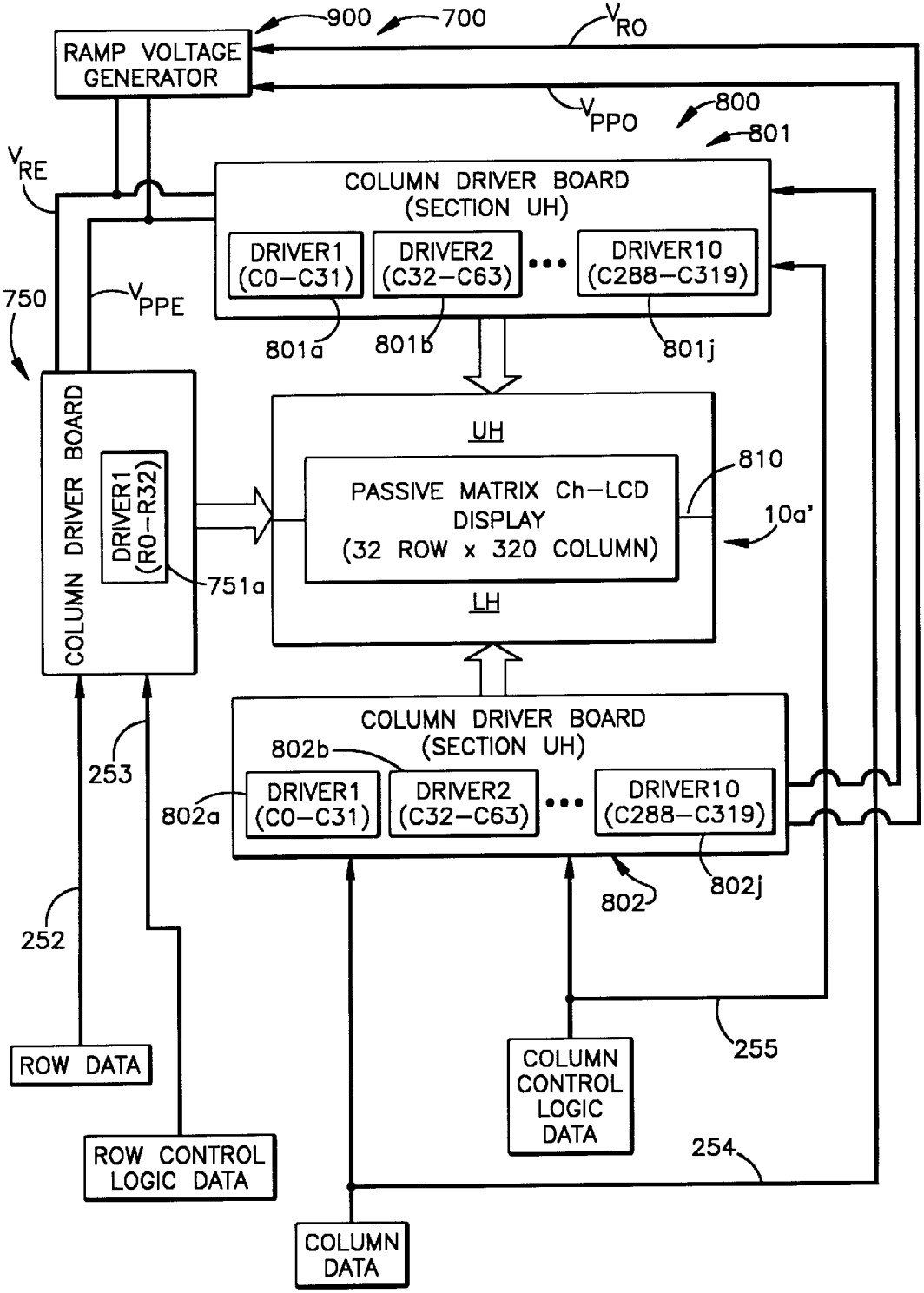
FIG. 15A is a schematic block diagram of driver circuitry of the display of FIG. 15 wherein the size of the video rate display portion is doubled by providing dual column driver circuitry.

In this embodiment, shown in FIGS. 15 and 15A, a viewer 12' includes a passive matrix cholesteric liquid crystal display 10'. The display 10' includes a video rate updating portion 10*a'* (similar to the video rate updating portion 10*a* of the first operating embodiment) and a static portion 10*b'* (similar to the static portion 10*b* of the first operating embodiment). The video rate updating portion 10*a'* of this embodiment includes 32 electrode segment rows and 320 electrode segment columns and is comprised of two sections UH, LH. Display driver circuitry 700 includes row driver circuitry 750 and column driver circuitry 800, a ramp voltage generator (similar to the ramp voltage generator 300 described in the first operating embodiment) and a controller (similar to the controller and associated circuitry 250 described in the first operating embodiment). The column driver circuitry 800 includes dual or two sets of column driver circuitry 801, 802, each mounted on a column driver board. The first set of column driver circuitry 801 drives column electrode segments in the upper section UH of the video rate updating portion 10*a'* which, of course, are also the column electrode segments associated with the static portion 10*b'* of the display 10'. The second set of column driver circuitry 802 drives column electrode segments in the lower section LH of the video rate updating portion 10*a'*. The column electrode segments of the upper section UH are not coupled to the column electrode segment of the lower section LH as indicated by the horizontal line 810 in FIG. 15A.

The upper section UH of the video rate updating portion 10*a'* includes a set of sixteen electrode segment rows (not shown) driven by sixteen output channels of a row drivern 751*a* of the row driver circuitry 750 mounted on a row driver board. The row drivern 751*a* is similar to the row driver 151*a* described in the first operating embodiment. The upper section UH also includes 320 electrode segment columns driven by the first set of column driver circuitry 801 mounted on a driver board including ten column drivers: driver1 801*a*, driver2 801*b*, . . . , driver10 801*j* each driving 32 column electrode segments. The ten column drivers driver1 801*a*, driver2 801*b*, . . . , driver3 801*j* are similar to the ten column drivers driver1 201*a*, driver2 201*b*, . . . , driver10 201*j* described in the first operating embodiment.

Similarly, the lower section LH of the video rate updating portion 10*a′* includes a set of sixteen electrode segment rows (not shown) driven by the remaining sixteen output channels of the row drivern 751*a* of the row driver circuitry 750. The upper section UH also includes 320 electrode segment columns (not shown) driven by the second set of column driver circuitry 802 including ten column drivers 802: driver1 802*a*, driver2 802*b*, . . . , driver10 802*j* each driving 32 column[s] electrode segments. The ten column drivers driver1 802*a*, 802*b*, . . . , 802*j* are similar to the ten column drivers driver1 201*a*, driver2 201*b*, . . . , driver10 201*j* described in the first operating embodiment.

The first and second sets of column drivers 801*a*, 801*b*, . . . , 801*j*, 802*a*, 802*b*, . . . , 802*j* receive column data signals from the controller via the bus 254 and receive column control logic signals from the controller via the bus 255. The row driver1 751*a* receives row data from the controller via the bus 252 and receives row control logic data from the controller via the bus 253.

The updating of both the upper and lower sections UH, LH occurs independently so that the total updating time for the video rate updating portion 10*a′* remains in the 96–112 ms. range. The controller coordinates the timing of the updating process so that the images displayed in the upper and lower sections UH, LH of the video rate updating portion 10*a′* are properly matching half parts of a unified image.

Second Alternate Embodiment—Interlaced Two Configuration

Figure 16:
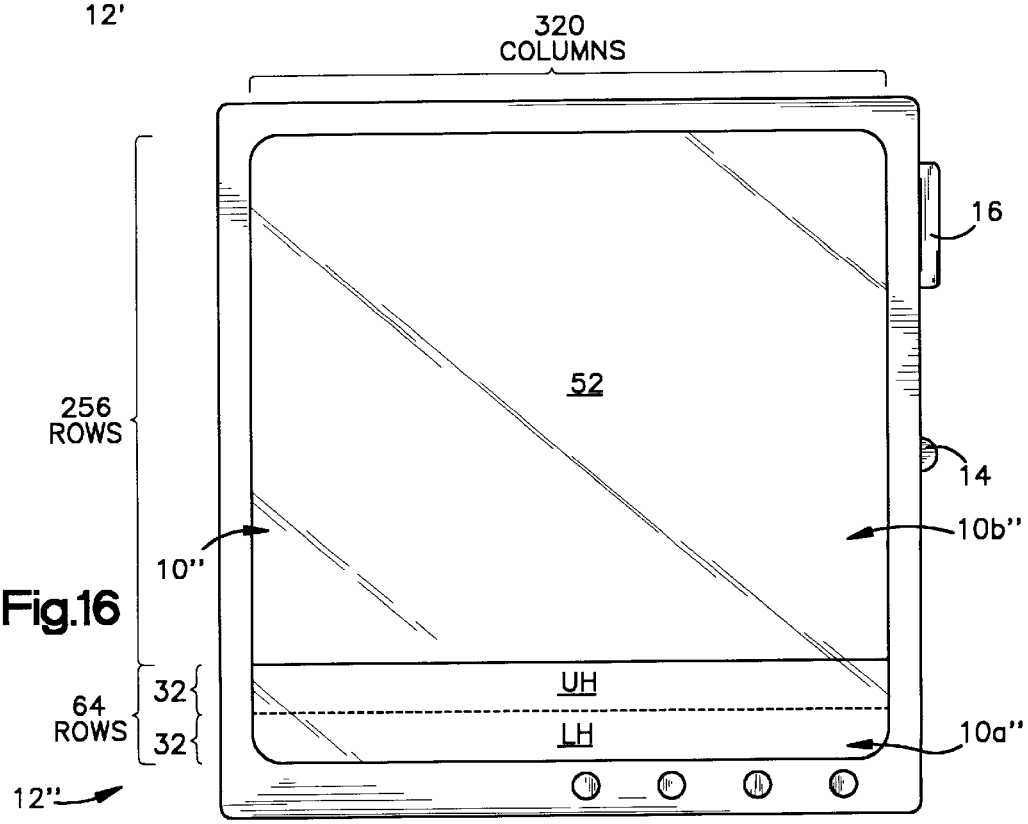
FIG. 16 is a top plan view of another alternate embodiment of a flat panel liquid crystal display of the present invention.
Figure 16A:
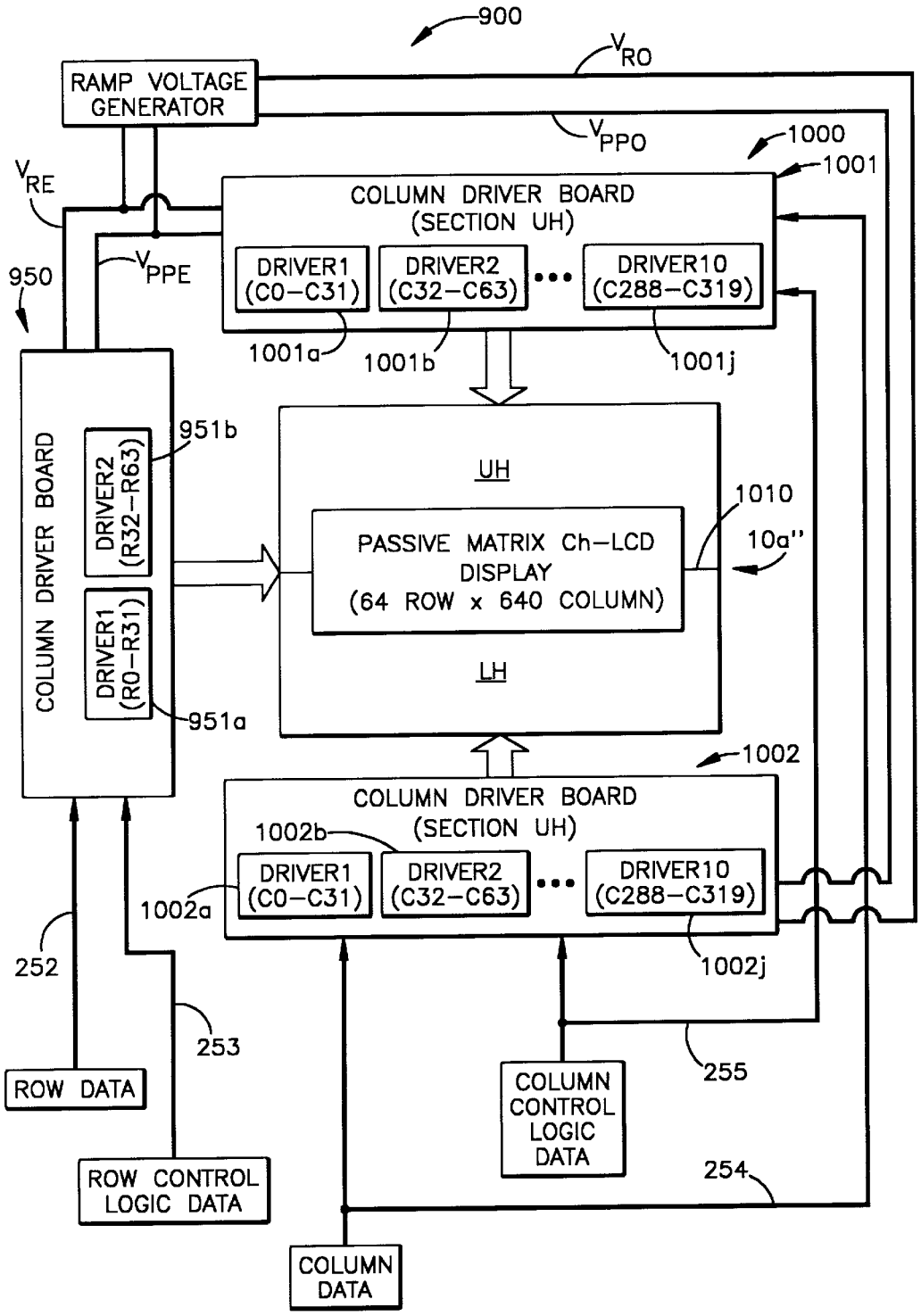
FIG. 16A is a schematic block diagram of driver circuitry of the display of FIG. 16 utilizing dual column driver circuitry and an interleaved two configuration for updating pixel rows to increase the size of the video rate display portion.

In this embodiment, shown in FIGS. 16 and 16A, a viewer 12" includes a passive matrix cholesteric liquid crystal display 10". The display 10" includes a video rate updating portion 10*a″* (similar to the video rate updating portion 10*a* and 10*a′* of the first operating embodiment and the first alternate embodiment) and a static portion 10*b″* (similar to the static portion 10*b* and 10*b′* of the first operating embodiment and the first alternate embodiment). The video rate updating portion 10*a″* this embodiment includes 64 electrode segment rows and 320 electrode segment columns and is comprised of two independently updated sections UH, LH. The static portion 10*b″* of this embodiment includes 256 electrode segment rows and 320 electrode segment columns.

Display driver circuitry 900 includes row driver circuitry 950 and column driver circuitry 1000 (having dual sets of column driver circuitry 1001, 1002 mounted on separate driver boards), a ramp voltage generator (similar to the ramp voltage generator 300 described in the first operating embodiment) and a controller (similar to the controller and associated circuitry 250 described in the first operating embodiment). The column driver circuitry 1000 includes dual or two sets of column driver circuitry 1001, 1002, each mounted on a column driver board. The first set of column driver circuitry 1001 drives column electrode segments in the upper section UH of the video rate updating portion 10*a″* which, of course, are also the column electrode segments associated with the static portion 10*b″* of the display 10". The second set of column driver circuitry 1002 drives column electrode segments in the lower section LH of the video rate updating portion 10*a″*. The column electrode segments of the upper section UH are not coupled to the column electrode segment of the lower section LH as indicated by the horizontal line 1010 in FIG. 16A.

All the components are the same in this embodiment of the viewer 12" as in the dual row driver embodiment of the viewer 12' discussed immediately above except that two row drivers, driver1 951*a*, driver2 951*b* are need since both sections LH and UH have 32 row electrode segments. Drivers 951*a*, 951*b* are similar to driver1 151*a*, 151*b* in the first operating embodiment. The row driver1 951*a* updates row electrode segments R0–R31, while the row driver2 951*b* updates row electrode segments R32–R63. The updating sequence or pattern for each row driver would be as follows:

| Time Period | Row Updated Row Driver1 | Row Updated Row Driver2 |
|---|---|---|
| 1 | R0 | R32 |
| 2 | R2 | R34 |
| 3 | R4 | R36 |
| 4 | R6 | R38 |
| 5 | R8 | R40 |
| 6 | R10 | R42 |
| . | . | . |
| . | . | . |
| . | . | . |
| 15 | R28 | R60 |
| 16 | R30 | R62 |
| 17 | R1 | R33 |
| 18 | R3 | R35 |
| 19 | R5 | R37 |
| . | . | . |
| . | . | . |
| . | . | . |
| 31 | R29 | R61 |
| 32 | R31 | R63 |
| 33 | R0 | R32 |
| 34 | R2 | R34 |
| . | . | . |
| . | . | . |
| . | . | . |

As can be seen, in this interlaced or interleaved two configuration, a given pixel row is selected or updated once every two interations of its row driver, that is, once every 2× 16 ms.=32 ms. Thus, the total time to change the reflectance state of an individual pixel pi,j is double the time needed in the previously discussed embodiments: Time to change reflectance state =6 pulses×32 ms. between successive pulses =192 ms. This updating rate of 192 ms. is too slow to be characterized as a video updating rate, but would more properly be termed a near video updating rate.

Third Alternate Embodiment—Interlaced Three Configuration

Figure 17:
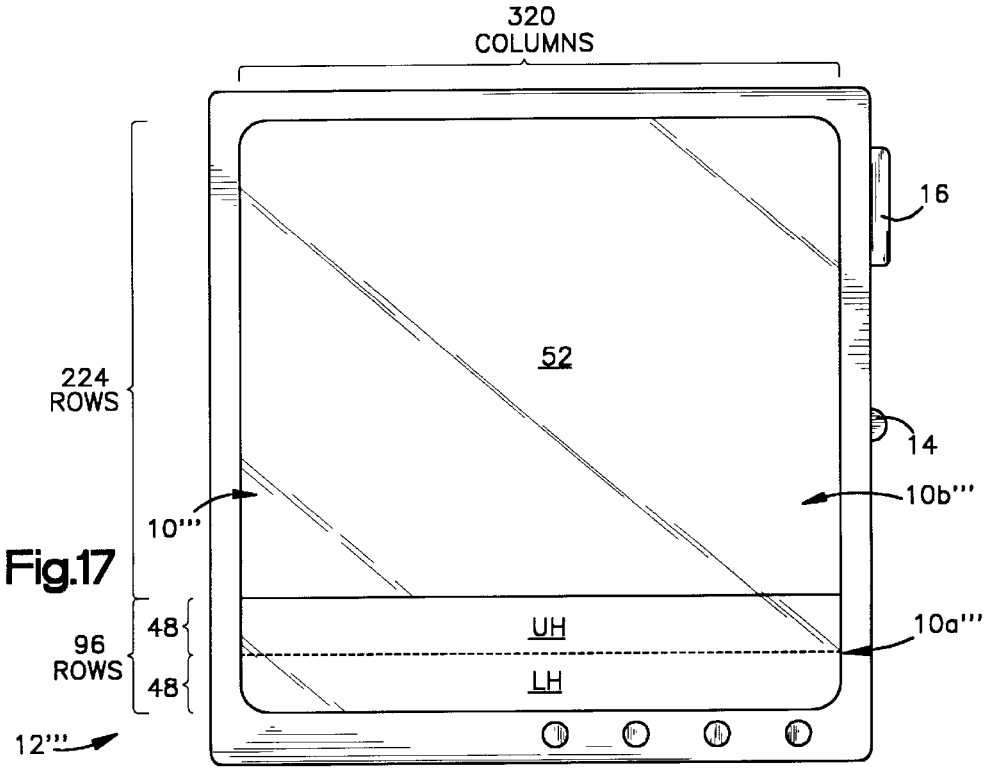
FIG. 17 is a top plan view of another alternate embodiment of a flat panel liquid crystal display of the present invention.
Figure 17A:
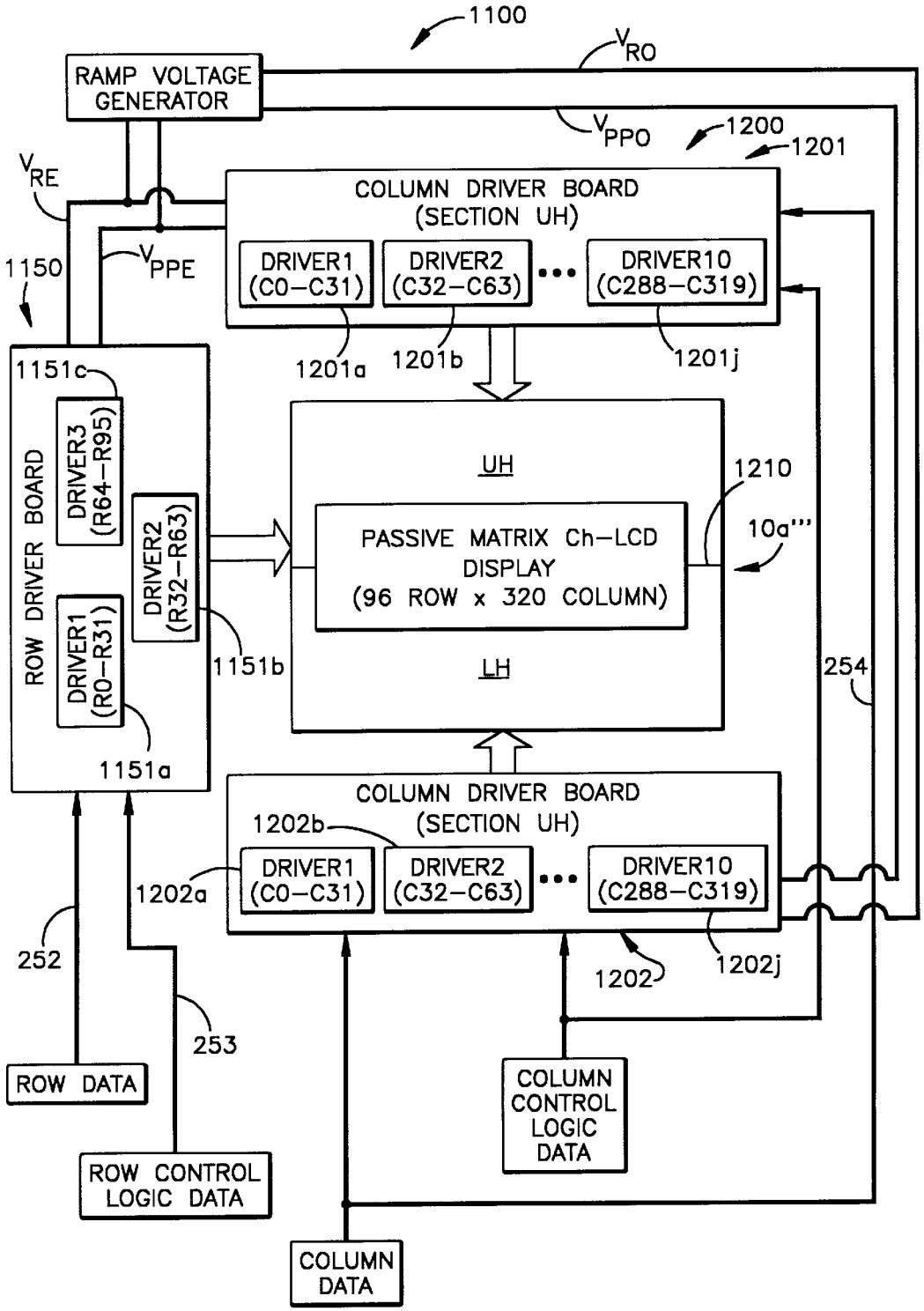
FIG. 17A is a schematic block diagram of driver circuitry of the display of FIG. 17 utilizing dual column driver circuitry and an interleaved three configuration for updating pixel rows to increase the size of the video rate display portion.

This embodiment, shown in FIG. 17 and 17A, is a further extension from an interlaced or interleaved two scheme (described with respect to FIGS. 16 and 16A) to an interlaced or interleaved three scheme to further increase the number of pixels rows updated at a near video updating rate to 96. In this embodiment, a viewer 12'" includes a passive matrix cholesteric liquid crystal display 10'". The display 10'" includes a video rate updating portion 10*a‴* (similar to the video rate updating portion 10*a*, 10*a′*, and 10*a″* of the first operating embodiment and the first and second alternate embodiments) and a static portion 10*b‴* (similar to the static portion 10*b*, 10*b′*, 10*b″* of the first operating embodiment and the first and second alternate embodiments). The video rate updating portion 10*a‴* of this embodiment includes 96 electrode segment rows and 320 electrode segment columns and is comprised of two sections UH, LH. The static portion 10*b‴* of this embodiment includes 224 electrode segment rows and 320 electrode segment columns.

Display driver circuitry 1100 includes row driver circuitry 1150 and column driver circuitry 1200 (having dual sets of column driver circuitry 1201, 1202 mounted on separate driver boards), a ramp voltage generator (similar to the ramp voltage generator 300 described in the first operating embodiment) and a controller (similar to the controller and associated circuitry 250 described in the first operating embodiment). The column driver circuitry 1200 includes dual or two sets of column driver circuitry 1201, 1202, each mounted on a column driver board. The first set of column driver circuitry 1201 drives column electrode segments in the upper section UH of the video rate updating portion 10*a'''* which, of course, are also the column electrode segments associated with the static portion 10*b'''* of the display 10'''. The second set of column driver circuitry 1202 drives column electrode segments in the lower section LH of the video rate updating portion 10*a'''*. The column electrode segments of the upper section UH are not coupled to the column electrode segment of the lower section LH as indicated by the horizontal line 910 in FIG. 16A.

All the components are the same in this embodiment of the viewer 12''' as in the dual row driver embodiment of the viewer 12' and the dual row driver interleaved two configuration embodiment of the viewer 12" discussed immediately above. However, in this embodiment, there are three row drivers, driven1 1151*a*, driver2 1151*b*, driver3 1151*c*. The row driver1 1151*a* is coupled to the row electrode segments R0–R31, the row driver2 1151*b* is coupled to the row electrode segments R32–R63, and the row driver3 1151*c* is coupled to the row electrode segments R64–R95. The updating sequence or pattern for each driver would be as follows:

| Time Period | Row Updated Row Drivers1&2 | Row Updated Row Drivers3&4 |
|---|---|---|
| 1 | R0 | R48 |
| 2 | R3 | R51 |
| 3 | R6 | R54 |
| 4 | R9 | R57 |
| 5 | R12 | R60 |
| 6 | R15 | R63 |
| . | . | . |
| . | . | . |
| . | . | . |
| 15 | R42 | R90 |
| 16 | R45 | R93 |
| 17 | R1 | R49 |
| 18 | R4 | R52 |
| 19 | R7 | R55 |
| . | . | . |
| . | . | . |
| . | . | . |
| 31 | R43 | R91 |
| 32 | R46 | R94 |
| 33 | R2 | R50 |
| 34 | R5 | R53 |
| . | . | . |
| . | . | . |
| . | . | . |

As can be seen, in the interleaved three configuration, a given pixel row is selected or updated once every three interations or sweeps of its row driver, that is, once every 3×16 ms.=48 ms. Thus, the total time to change the reflectance state of an individual pixel pi,j is double the time needed in, the previously discussed embodiments: Time to change reflectance state=6 pulses×48 ms. between successive pulses=288 ms. This updating rate of 288 ms. is too slow to be characterized as a video updating rate, but would more properly be termed a near video updating rate.

While the present invention has been described with a degree of particularity, it is the intent that the invention include all modifications and alterations from the disclosed design falling within the spirit and scope of the appended claims.

What is claimed is:

1. A method for changing a reflective state of picture elements that make up a flat-panel liquid crystal display comprising the steps of:

a) arranging a voltage control addressing electrodes in relation to a layer of liquid crystal material that makes up the flat panel liquid crystal display for applying a control voltage across controlled picture element locations of the liquid crystal material;

b) defining a first voltage level for a application to a picture element of the display for converting said picture element from a relatively high reflective initial state to a relatively low reflective final stage; said first voltage level of a size to maintain a picture element in a low reflective state if said picture element is initially in a low reflective state;

c) defining a second voltage level for application to a picture element of the display for converting said picture element from a relatively low reflective initial state of a relatively high reflective final state; said second voltage level of a size to maintain a picture element in the high reflective state if said picture element is initially in a high reflective state;

d) defining a third voltage level for application to those picture element that are not subject to application of said first voltage level or said second voltage level, said third voltage level of an amplitude sufficiently low to retain said picture elements in their respective present reflective states; and e) converting control signals indicating a reflective state of all picture elements into said first, second and third voltage levels and applying said first, second and third voltage levels to said voltage control addressing electrodes in a synchronized manner to refresh said liquid crystal display at at least a near video rate;

1) said first voltage level applied to a picture element as a series of short duration pulses of the first voltage level, a duration of a voltage pulse, defined as ton1, being such that a plurality of voltage pulses are required to convert the picture element from the relatively high reflective initial state to the relatively low reflective final state wherein a time between positive going edges of successive voltage pulses, defined as T1, is greater that ton1;

2) said second voltage level applied to a picture element as a series of short duration pulses of the second voltage level, a duration of a voltage pulse, defined as ton2, being such that a plurality of voltage pulses are required to convert the picture element from the relatively low reflective initial state of the relatively high reflective final state wherein a time between positive going edges of successive voltage pulses, defined as T2, is greater than ton2; and 3) said third voltage level applied to said picture elements that are not subject to application of said first voltage level or said second voltage level.

2. The method of claim 1 wherein the short duration voltage pulses of the first voltage level and the short duration voltage pulses of the second voltage level are approximately 1 millisecond in duration.

3. The method of claim 1 wherein the voltage control addressing electrodes are arranged in intersecting electrode rows and electrode columns and wherein electrode rows are positioned on one side of the layer of liquid crystal material and electrode columns are postioned on an opposite side of the layer of liquid crystal material.

4. The method of claim 3 wherein the electrode rows and columns are selectively energized with a selected one of a plurality of voltage pulses having an alternating square wave waveform.

5. The method of claim 3 wherein a picture element is changed from the relatively low reflective initial state to the relatively high reflective final state by application of the second voltage level as a series of bi-polar pulses that form a waveform in a range of positive 60 volts to negative 60 volts.

6. The method of claim 3 wherein the picture element is changed from the relatively high reflectance initial state to the relatively low reflective final state by application of the first voltage level as a series of bi-polar pulses that form a waveform in a range of negative 50 volts to positive 50 volts.

7. The method of claim 4 wherein voltage pulses are simultaneously applied to row and column electrodes such that the voltage at the intersection of an energized row and column provides either voltage pulses of the first voltage level or voltage pulses of the second voltage level.

8. The method of claim 1 wherein the control signals are converted from a video memory for storing a desired reflectance state of each of the picture elements that make up the display into a series of values that, for each picture element, determines whether the first or the second voltage value is applied to the picture element.

9. The method of claim 3 wherein the control signals are converted from a video memory for storing a desired reflectance state of each of the picture elements that make up the display into a series of row electrode energization pulses and column electrode energization pulses that are synchronized to achieve updating of all picture elements that make up the display at at least the near video updating rate.

10. Display apparatus for displaying an image comprising:

a) a chiral nematic liquid crystal display material that forms a sheet which extends over an image area for presenting a viewing image;

b) confining structure for encapsulating the sheet of liquid crystal display material that includes electrode structure for imposing a selection field across a thickness of the liquid crystal display material for applying the selection field across individually controllable pixels that make up the image area; and c) drives circuitry for updating the pixels at a video refresh rate by applying a first voltage level across the thickness of the liquid crystal display material to those pixels to be converted from a relatively high reflective initial state to a relatively low reflective final state and to those pixels to be maintained in a low reflective state, the first voltage level being applied as a series of short duration pulses of the first voltage level, a duration of a voltage pulse, defined as ton1, being such that a plurality of voltage pulses are required to convert a pixel from the relatively high reflective initial state to the relatively low reflective final state wherein a time between leading edges of successive voltage pulses, defined as T1, is greater than ton1 and by applying a second voltage level across the thickness of the liquid crystal display material to those pixels to be converted from a relatively low reflective initial state to a relatively high reflective final state and to those pixels to be maintained in a high reflective state, the second voltage level being applied as a series of short duration pulses of the second voltage level, a duration of a voltage pulse, defined as ton2, being such that a plurality of voltage pulses are required to convert a pixel from the relatively low reflective state to the relatively high reflective final state wherein a time between leading edges of successive voltage pulses, defined as T2, is greater than ton2 and by applying a third voltage level across the thickness of the liquid crystal display material to those pixels not subject to application of said first voltage level or said second voltage level, said third voltage level of an amplitude sufficiently low to retain said pixels in their respective present reflective states.

11. Driver circuitry for changing a reflective state of an array of picture elements that make up a flat-panel liquid crystal display, a picture element being defined by an intersection of a first row electrode segment of a set of row electrode segments and a first column electrode segment of a set of column electrode segments, the sets of row and column electrode being spaced apart by a layer of liquid crystal material, the driver circuitry comprising:

a) row driver circuitry electrically coupled to the set of row electrode segments and generating a row waveform;

b) column driver circuitry electrically coupled to the set of column electrode segments and generating a column waveform;

c) control circuitry coupled to the row driver circuitry and the column driver circuitry for synchronizing generation and application of the row waveform and the column waveform to the first row electrode segment and the first column electrode segment to generate a resultant voltage across the picture element, which changes the reflective state of the picture element; and d) the resultant voltage being a first voltage level if the picture element is to be converted from a relatively high reflective initial state to a relatively low reflective final state or is to be maintained in a low reflective state, the first voltage level being applied as a series of short duration of the first voltage level, a duration of a voltage pulse, defined as ton1, being such that a plurality of voltage pulses are required to convert the picture element from the relatively high reflective initial state to be relatively low reflective final state wherein a time between leading edges of successive voltage pulses, defined as T1, is greater than ton1, the resultant voltage being a second voltage level if the picture element is to be converted from a relatively low reflective initial state to a relatively high reflective final state or is to be maintained in a high reflective state and the resultant voltage being a third voltage level which is applied to those picture elements not subject to application of said first voltage level or said second voltage level, said third voltage level of an amplitude sufficiently low to retain said picture elements in their respective present reflective states.

12. The driver circuitry of claim 11 wherein a pulse width of the plurality of voltage pulses of the resultant voltage is substantially equal to 1 millisecond.

13. The driver circuitry of claim 12 wherein the second voltage level is applied as a series of short duration pulses of the second voltage level, a duration of a voltage pulse, defined as ton2, being such that a plurality of voltage pulses are required to convert the picture element from the relatively low reflective initial state to the relatively high reflective final state wherein a time between leading edges of successive voltage pulses, defined as T2, is greater than ton2.

14. The driver circuitry of claim 13 wherein each the plurality of voltage pulses of the resultant voltage comprises a substantially alternating square wave waveform.

15. The driver circuitry of claim 13 wherein the picture element is changed from the relatively low reflective initial state to the relatively high reflective final state by application of the second voltage level as a series of bipolar pulses than form a waveform in a range of substantially positive 60 volts to negative 60 volts.

16. The driver circuitry of claim 11 wherein the row waveform comprises a unipolar waveform having a duration of substantially 1 millisecond.

17. The driver circuitry of claim 16 wherein the unipolar waveform of the row waveform comprises a first square wave portion having a magnitude of substantially positive 60 volts and a duration of substantially 0.5 milliseconds and a second portion having a magnitude of substantially 0 volts and a duration of substantially 0.5 milliseconds.

18. The driver circuitry of claim 11 wherein the column row waveform comprises a unipolar waveform having a duration of substantially 1 millisecond.

19. The driver circuitry of claim 18 wherein the unipolar waveform of the column waveform comprises a first portion having a magnitude of substantially zero volts and a duration of substantially 0.5 seconds and a second portion having a magnitude of substantially positive 60 volts and a duration of substantially 0.5 milliseconds.

20. The driver circuitry of claim 11 wherein the row waveform comprises a bipolar waveform having a duration of substantially 1 millisecond.

21. The driver circuitry of claim 20 wherein the bipolar waveform of the row waveform comprises a first square wave portion having a magnitude of substantially positive 60 volts and a duration of substantially 0.5 milliseconds and a second portion having a magnitude of substantially negative 60 volts and a duration of substantially 0.5 milliseconds.

22. The driver circuitry of claim 11 wherein the column waveform comprises a bipolar waveform having a duration of substantially 1 millisecond.

23. The driver circuitry of claim 22 wherein the bipolar waveform of the column waveform comprises a first portion having a magnitude of substantially negative five volts and a duration of substantially 0.5 seconds and a second portion having a magnitude of substantially positive 5 volts and a duration of substantially 0.5 milliseconds.

24. The driver circuitry of claim 11 wherein the picture element is changed from the relatively high reflective initial state to the relatively low reflective final state by application of the second voltage level as a series of bipolar pulses that form a waveform in a range of substantially negative 50 volts to positive 50 volts.

25. The driver circuitry of claim 11 wherein the row waveform comprises a unipolar waveform having a duration of substantially 1 millisecond.

26. The driver circuitry of claim 25 wherein the unipolar waveform of the row waveform comprises a first square wave portion having a magnitude of substantially positive 60 volts and a duration of substantially 0.5 milliseconds and a second portion having a magnitude of substantially 0 volts and a duration of substantially 0.5 milliseconds.

27. The driver circuitry of claim 24 wherein the column waveform comprises a unipolar waveform having a duration of substantially 1 millisecond.

28. Driver circuitry for changing a reflective state of an array of picture elements that make up a flat-panel liquid crystal display, a picture element being defined by an intersection of a first row electrode segment of a set of row electrode segments and a first column electrode segment of a set of column electrode segments, the sets of row and column electrode segments being spaced apart by a layer of liquid crystal material, the driver circuitry comprising:

a) row driver circuitry electrically coupled to the set of row electrode segments and generating a row waveform;

b) column driver circuitry electrically coupled to the set of column electrode segments and generating a column waveform;

c) control circuitry coupled to the row driver circuitry and the column driver circuitry for synchronizing generation and application of the row waveform and the column waveform to the first row electrode segment and the first column electrode segment to generate a resultant voltage across the element which changes the reflective state of the picture element; and d) the resultant voltage being a first voltage level if the picture element is to be converted from a relatively low reflective initial state to a relatively high reflective final state or is to be maintained in a high reflective state, the first voltage level being applied as a series of short duration pulses of the first voltage level, a duration of a voltage pulse, defined as ton2, being such that a plurality of voltage pulses are required to convert the picture element from the relatively low reflective initial state to the relatively high reflective final state wherein a time between leading edges of successive voltage pulses, defined as T2, is greater than ton2, the resultant voltage being a second voltage level if the picture element is to be converted from a relatively high reflective initial state to a relatively low reflective final state or is to be maintained in a low reflective state and the resultant voltage being a third voltage level which is applied to those picture elements not subject to application of said first voltage level or said second voltage level, said third voltage level of an amplitude sufficiently low to retain said picture elements in their respective present reflective states.

29. The driver circuitry of claim 28 wherein a pulse width of the plurality of voltage pulses of the resultant voltage is substantially equal to 1 millisecond.

30. The driver circuitry of claim 28 wherein the second voltage level is applied as a series of short duration pulses of the second voltage level, a duration of a voltage pulse, defined as ton1, being such that a plurality of voltage pulses are required to convert the picture element from the relatively high reflective initial state to the relatively low reflective final state wherein a time between leading edges of successive pulses, defined as T1, is greater than ton1.

31. The driver circuitry of claim 28 wherein the amplitude of said third voltage level is in a range of substantially zero volts to Vt volts, where Vt is a threshold voltage that is the maximum voltage magnitude which can be applied to a picture element and still retain said picture element in its present reflective state.

32. The driver circuitry of claim 28 wherein said flat-panel liquid crystal display is a matrix display and wherein said third voltage level is substantially equal to one half of the absolute value of a difference said first voltage level and said second voltage level.

33. The method of claim 1 wherein the amplitude of said third voltage level is in a range of substantially zero volts to Vt volts, where Vt is a threshold voltage that is the maximum voltage magnitude which can be applied to a picture element and still retain said picture element in its present reflective state.

34. The method of claim 1 wherein said display is a matrix display and wherein said third voltage level is substantially equal to one half of the absolute value of a difference between said first voltage level and said second voltage level.

35. The display apparatus of claim 10 wherein the amplitude said third voltage level is in a range of substantially zero volts to Vt volts, where Vt is a threshold voltage that is the maximum voltage magnitude which can be applied to a pixel and still retain said pixel in its present reflective state.

36. The display apparatus of claim 10 wherein said display apparatus is a matrix display and wherein said third voltage level is substantially equal to one half of the absolute value of a difference between said first voltage level and said second voltage level.

37. The driver circuitry of claim 11 wherein the amplitude of said third voltage level is in a range of substantially zero volts to Vt volts, where Vt is a threshold voltage that is the maximum voltage magnitude which can be applied to a picture element and still retain said picture element in its present reflective state.

38. The driver circuitry of claim 11 wherein said flat-panel liquid crystal display is a matrix display and wherein said third voltage level is substantially equal to one half of the absolute value of a difference between said first voltage level and said second voltage level.

39. The method of claim 1 wherein T1 is greater than twice ton1 and wherein T2 is greater than twice ton2.

40. The method of claim 1 wherein T1 and T2 are greater than or equal to 16 milliseconds.

41. The method of claim 1 wherein for the series of short duration pulses of the first voltage level a time between an ending of a voltage pulse and a starting of a next successive voltage pulse is greater than or equal to ton1 and for the series of short duration pulses of the second voltage level a time between an ending of a voltage pulse and a starting of a next successive voltage pulse is greater than or equal to ton2.

42. The method of claim 1 wherein the liquid crystal display is a cholesteric liquid crystal display.

* * * * *

UNITED STATES PATENT AND TRADEMARK OFFICE

CERTIFICATE OF CORRECTION

PATENT NO. : 6,133,895
DATED : October 17, 2000
INVENTOR(S) : Xiao-Yang Huang

It is certified that error appears in the above-identified patent and that said Letters Patent is hereby corrected as shown below:

Column 28,
Line 13, “stage” should read -- state --.
Line 21, “of” should read -- to --.
Line 26, “element” should read -- elements --.

Column 29,
Line 45, “drives” should read -- drive --.

Column 30,
Line 1, after “reflective” insert -- initial --.
Line 16, after “electrode” insert -- segments --.
Line 29, after “element” delete the comma “,”.
Line 36, after “duration” (first occurrence) insert -- pulses --.
Line 65, after “each” insert -- of --.

Column 31,
Line 39, “seconds” should read -- milliseconds --.

Column 32,
Line 12, after “the” insert -- picture --.

Signed and Sealed this

Sixth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,133,895
APPLICATION NO. : 08/868709
DATED : October 17, 2000
INVENTOR(S) : Xiao-Yang Huang It is certified that error appears in the above-identified patent and that said Letters Patent is hereby corrected as shown below:

Column 28, line 5, after “arranging”, delete “a”.

Column 28, line 10, after “for”, delete “a”.

Column 28, line 51, “of” should read --to--.

Column 30, line 40, “be” should read --the--.

Column 31, line 4, “then” should read --that--.

Column 32, line 55, after “difference” insert --between--.

Column 33, line 2, before “said” insert --of--.

Signed and Sealed this

Eleventh Day of July, 2006

JON W. DUDAS
*Director of the United States Patent and Trademark Office*